US011454241B2

(12) United States Patent
Shaffer et al.

(10) Patent No.: US 11,454,241 B2
(45) Date of Patent: Sep. 27, 2022

(54) LIQUID COOLING OF FIXED AND ORBITING SCROLL COMPRESSOR, EXPANDER OR VACUUM PUMP

(71) Applicant: Air Squared, Inc., Broomfield, CO (US)

(72) Inventors: Bryce R. Shaffer, Denver, CO (US); Nathan D. Nicholas, Westminster, CO (US); Justin D. Mattice, Denver, CO (US); John P. D. Wilson, Denver, CO (US)

(73) Assignee: Air Squared, Inc., Broomfield, CO (US)

( * ) Notice: Subject to any disclaimer, the term of this patent is extended or adjusted under 35 U.S.C. 154(b) by 303 days.

(21) Appl. No.: 16/213,111

(22) Filed: Dec. 7, 2018

(65) Prior Publication Data

US 2019/0338779 A1 Nov. 7, 2019

Related U.S. Application Data

(60) Provisional application No. 62/700,767, filed on Jul. 19, 2018, provisional application No. 62/762,437, filed on May 4, 2018.

(51) Int. Cl.
*F04C 29/04* (2006.01)
*F01C 1/02* (2006.01)
(Continued)

(52) U.S. Cl.
CPC ..... *F04C 29/04* (2013.01); *F01C 1/0223* (2013.01); *F01C 21/06* (2013.01);
(Continued)

(58) Field of Classification Search
CPC .... F04C 29/023; F04C 18/02; F04C 18/0215; F04C 18/0253; F04C 23/008;
(Continued)

(56) References Cited

U.S. PATENT DOCUMENTS 801,182 A 10/1905 Creux
2,079,118 A 5/1937 Hingst
(Continued)

FOREIGN PATENT DOCUMENTS

CN 104235018 12/2014
CN 104632636 5/2015
(Continued)

OTHER PUBLICATIONS

"Heat Pump and Refrigeration Cycle," Wikipedia, last updated May 10, 2013, 4 pages [retrieved online from: en.wikipedia.org/wiki/Heat_pump_and_refrigeration_cycle].
(Continued)

*Primary Examiner* — Dominick L Plakkoottam
*Assistant Examiner* — Paul W Thiede
(74) *Attorney, Agent, or Firm* — Sheridan Ross P.C.

(57) ABSTRACT

A scroll device has a fixed scroll, and orbiting scroll, and at least one cooling chamber configured to receive coolant to cool the fixed scroll or the orbiting scroll. A flexible conduit that curves around an orbital axis of the orbiting scroll may transfer coolant into or out of the at least one cooling chamber. The scroll device may have a motor with a motor jacket configured to receive coolant for cooling the motor. One or more involutes of the scroll device may comprise a wall coated or plated with a solid abrasion-resistant lubricant.

18 Claims, 20 Drawing Sheets

(51) Int. Cl.
*F04C 18/02* (2006.01)
*F01C 21/06* (2006.01)

(52) U.S. Cl.
CPC ..... *F04C 18/0215* (2013.01); *F04C 18/0223* (2013.01); *F01C 1/0215* (2013.01); *F04C 29/042* (2013.01); *F04C 2240/806* (2013.01)

(58) Field of Classification Search
CPC ..... F04C 29/025; F04C 29/028; F04C 29/04; F04C 18/0223; F04C 2240/806; F04C 29/042; F04C 15/0096; F04C 25/02; F05B 2210/30; F05B 2210/40; F05B 2240/60; F05B 2260/98; F01C 1/0223; F01C 21/06; F01C 1/0215
USPC ..... 418/55.1–55.6, 88, 97, 101, 150, 182, 418/270; 417/410.1; 428/403
See application file for complete search history.

(56) References Cited

U.S. PATENT DOCUMENTS 2,330,121 A 9/1943 Heintz
2,475,247 A 7/1949 Mikulasek
2,968,157 A 1/1961 Cronan
3,011,694 A 12/1961 Mulhouse et al.
3,262,573 A 7/1966 Schutte
3,470,704 A 10/1969 Kantor
3,600,114 A 8/1971 Miloslav et al.
3,613,368 A 10/1971 Doerner
3,802,809 A 4/1974 Vulliez
3,842,596 A 10/1974 Gray
3,874,827 A 4/1975 Young
3,884,599 A 5/1975 Young et al.
3,924,977 A 12/1975 McCullough
3,986,799 A 10/1976 McCullough
3,986,852 A 10/1976 Doerner et al.
3,994,633 A 11/1976 Shaffer
3,994,635 A 11/1976 McCullough
3,994,636 A 11/1976 McCullough et al.
3,999,400 A 12/1976 Gray
4,065,279 A 12/1977 McCullough
4,069,673 A 1/1978 Lapeyre
4,082,484 A 4/1978 McCullough
4,121,438 A 10/1978 McCullough
4,129,405 A 12/1978 McCullough
4,157,234 A 6/1979 Weaver et al.
4,160,629 A 7/1979 Hidden et al.
4,192,152 A 3/1980 Armstrong et al.
4,199,308 A 4/1980 McCullough
4,216,661 A 8/1980 Tojo et al.
4,259,043 A 3/1981 Hidden et al.
4,300,875 A 11/1981 Fischer et al.
4,340,339 A 7/1982 Hiraga et al.
4,382,754 A 5/1983 Shaffer et al.
4,395,205 A 7/1983 McCullough
4,395,885 A 8/1983 Cozby
4,403,494 A 9/1983 McCullough
4,411,605 A 10/1983 Sauls
4,415,317 A 11/1983 Buttersworth
4,416,597 A 11/1983 Eber et al.
4,424,010 A 1/1984 McCullough
4,436,495 A 3/1984 McCullough
4,457,674 A 7/1984 Kawano et al.
4,462,771 A 7/1984 Teegarden
4,463,591 A 8/1984 McCullough
4,472,120 A 9/1984 McCullough
4,475,346 A 10/1984 Young et al.
4,477,238 A 10/1984 Terauchi
4,511,091 A 4/1985 Vasco
4,512,066 A 4/1985 McCullough
4,515,539 A 5/1985 Etsuo
4,673,339 A 6/1987 Hayano et al.
4,718,836 A 1/1988 Pottier et al.
4,722,676 A 2/1988 Sugimoto
4,726,100 A 2/1988 Etemad et al.
4,730,375 A 3/1988 Nakamura et al.
4,732,550 A 3/1988 Suzuki et al.
4,802,831 A 2/1989 Suefuji et al.
4,832,586 A 5/1989 Emmenthal et al.
4,867,657 A 9/1989 Kotlarek et al.
4,875,839 A 10/1989 Sakata et al.
4,892,469 A 1/1990 McCullough et al.
4,911,621 A 3/1990 McCullough et al.
4,918,930 A 4/1990 Gaudet et al.
4,927,340 A 5/1990 McCullough
4,990,072 A 2/1991 Guttinger
5,013,226 A 5/1991 Nishida
5,037,280 A 8/1991 Nishida et al.
5,040,956 A 8/1991 Barito et al.
5,044,904 A 9/1991 Richardson, Jr.
5,051,075 A 9/1991 Young
5,051,079 A 9/1991 Richardson, Jr.
5,082,430 A 1/1992 Guttinger
5,099,658 A 3/1992 Utter et al.
5,108,274 A 4/1992 Kakuda et al.
5,127,809 A 7/1992 Amata et al.
5,142,885 A 9/1992 Utter et al.
5,149,255 A 9/1992 Young
5,157,928 A 10/1992 Gaudet et al.
5,160,253 A 11/1992 Okada et al.
5,176,004 A 1/1993 Gaudet
5,214,932 A 6/1993 Abdelmalek
5,222,882 A 6/1993 McCullough
5,224,849 A 7/1993 Forni
5,228,309 A 7/1993 McCullough
5,232,355 A 8/1993 Fujii et al.
5,242,284 A 9/1993 Mitsunaga et al.
5,247,795 A 9/1993 McCullough
RE34,413 E 10/1993 McCullough
5,256,042 A 10/1993 McCullough et al.
5,258,046 A 11/1993 Haga et al.
5,265,431 A 11/1993 Gaudet et al.
5,286,179 A 2/1994 Forni et al.
5,314,316 A 5/1994 Shibamoto et al.
5,328,341 A 7/1994 Forni
5,338,159 A 8/1994 Riffe et al.
5,343,708 A 9/1994 Gaudet et al.
5,354,184 A 10/1994 Forni
5,358,387 A 10/1994 Suzuki et al.
5,417,554 A 5/1995 Kietzman et al.
5,443,368 A 8/1995 Weeks et al.
5,449,279 A 9/1995 Hill et al.
5,450,316 A 9/1995 Gaudet et al.
5,462,419 A 10/1995 Hill et al.
5,466,134 A 11/1995 Shaffer et al.
5,496,161 A 3/1996 Machida et al.
5,609,478 A * 3/1997 Utter ..... F04C 18/023 418/55.5
5,616,015 A 4/1997 Liepert
5,616,016 A 4/1997 Hill et al.
5,632,612 A 5/1997 Shaffer
5,632,613 A 5/1997 Shin et al.
5,637,942 A 6/1997 Forni
5,640,854 A * 6/1997 Fogt ..... F01C 1/0215 62/197
5,720,602 A 2/1998 Hill et al.
5,746,719 A 5/1998 Ferra et al.
5,752,816 A 5/1998 Shaffer
5,759,020 A 6/1998 Shaffer
5,800,140 A 9/1998 Forni
5,803,723 A 9/1998 Suefuji et al.
5,836,752 A 11/1998 Calhoun et al.
5,842,843 A 12/1998 Haga
5,855,473 A 1/1999 Liepert
5,857,844 A 1/1999 Lifson et al.
5,873,711 A 2/1999 Lifson
5,938,419 A 8/1999 Honma et al.
5,951,268 A 9/1999 Pottier et al.
5,961,297 A 10/1999 Haga et al.
5,987,894 A 11/1999 Claudet
6,008,557 A 12/1999 Dornhoefer et al.
6,022,195 A 2/2000 Gaudet et al.
6,050,792 A 4/2000 Shaffer

(56) References Cited

U.S. PATENT DOCUMENTS 6,068,459 A 5/2000 Clarke et al.
6,074,185 A 6/2000 Protos
6,098,048 A 8/2000 Dashefsky et al.
6,129,530 A 10/2000 Shaffer
6,179,590 B1 1/2001 Honma et al.
6,186,755 B1 2/2001 Haga
6,190,145 B1 * 2/2001 Fujioka ..... F04C 29/04 417/371
6,193,487 B1 2/2001 Ni
6,213,970 B1 4/2001 Nelson et al.
6,283,737 B1 9/2001 Kazikis et al.
6,318,093 B2 11/2001 Gaudet et al.
6,379,134 B2 4/2002 Iizuka
6,434,943 B1 8/2002 Garris
6,439,864 B1 8/2002 Shaffer
6,460,351 B2 10/2002 Gaudet et al.
6,461,113 B1 10/2002 Gaudet et al.
6,464,467 B2 10/2002 Sullivan et al.
6,511,308 B2 1/2003 Shaffer
6,623,445 B1 9/2003 Nelson et al.
6,644,946 B2 11/2003 Nakane et al.
6,663,364 B2 12/2003 Okada et al.
6,712,589 B2 3/2004 Mori et al.
6,736,622 B1 5/2004 Bush et al.
6,755,028 B2 6/2004 Gaudet et al.
6,902,378 B2 6/2005 Gaudet et al.
6,905,320 B2 6/2005 Satoh et al.
6,922,999 B2 8/2005 Kimura et al.
7,111,467 B2 9/2006 Apparao et al.
7,124,585 B2 10/2006 Kim et al.
7,144,383 B2 12/2006 Arnett et al.
7,181,928 B2 2/2007 de Larminat
7,201,568 B2 * 4/2007 Sakamoto ..... F04C 18/0215 417/410.5
7,234,310 B2 6/2007 Flynn et al.
7,249,459 B2 7/2007 Hisanaga et al.
7,297,133 B2 11/2007 Nelson et al.
7,306,439 B2 12/2007 Unami et al.
7,309,219 B2 * 12/2007 Komai ..... F01C 21/10 418/101
7,314,358 B2 1/2008 Tsuchiya
7,329,108 B2 * 2/2008 Tsuchiya ..... F04C 29/04 418/55.1
7,439,702 B2 10/2008 Smith et al.
7,458,152 B2 12/2008 Sato
7,458,414 B2 12/2008 Simon
7,836,696 B2 11/2010 Uno et al.
7,861,541 B2 1/2011 Dieckmann et al.
7,906,016 B2 3/2011 Weber et al.
7,942,655 B2 5/2011 Shaffer
7,980,078 B2 7/2011 McCutchen et al.
8,007,260 B2 8/2011 Yanagisawa
8,087,260 B2 1/2012 Ogata et al.
8,186,980 B2 5/2012 Komai et al.
8,328,544 B2 12/2012 Iwano et al.
8,484,974 B1 7/2013 Monson et al.
8,523,544 B2 9/2013 Shaffer
8,668,479 B2 3/2014 Shaffer
8,674,525 B2 3/2014 Van Den Bossche et al.
8,858,203 B2 * 10/2014 Kanaizumi ..... F04C 23/005 418/55.1
9,022,758 B2 5/2015 Roof et al.
9,028,230 B2 * 5/2015 Shaffer ..... F04C 29/0085 418/5
9,074,598 B2 7/2015 Shaffer et al.
9,115,719 B2 * 8/2015 Sadakata ..... F04C 15/0096
9,657,733 B2 5/2017 Chadwick et al.
9,784,139 B2 10/2017 Shaffer et al.
9,885,358 B2 2/2018 Shaffer
10,221,852 B2 3/2019 Shaffer et al.
2001/0012485 A1 8/2001 Gaudet et al.
2001/0038800 A1 11/2001 Kumura et al.
2001/0043878 A1 11/2001 Sullivan et al.
2002/0011332 A1 1/2002 Oh et al.
2002/0039534 A1 4/2002 Moroi et al.
2002/0071779 A1 6/2002 Moroi et al.
2002/0094277 A1 7/2002 Gaudet et al.
2002/0104320 A1 8/2002 Gaudet et al.
2003/0017070 A1 1/2003 Moroi et al.
2003/0051487 A1 3/2003 Gaudet et al.
2003/0138339 A1 7/2003 Scancarello
2003/0223898 A1 12/2003 Fujioka et al.
2004/0020206 A1 2/2004 Sullivan et al.
2004/0184940 A1 9/2004 Nakane et al.
2004/0194477 A1 10/2004 Gaudet et al.
2004/0241030 A1 12/2004 Matsushima
2004/0255591 A1 12/2004 Hisanga et al.
2005/0025651 A1 2/2005 Sowa et al.
2005/0031469 A1 2/2005 Yanagisawa et al.
2005/0081536 A1 4/2005 Gaudet et al.
2005/0169788 A1 * 8/2005 Komai ..... F04C 18/0253 418/55.6
2005/0196284 A1 9/2005 Gaudet et al.
2005/0220649 A1 10/2005 Sato
2006/0016184 A1 1/2006 Simon
2006/0045760 A1 * 3/2006 Haller ..... F04C 18/3442 417/307
2006/0045783 A1 3/2006 Yanagisawa et al.
2006/0130495 A1 6/2006 Dieckmann et al.
2007/0071626 A1 3/2007 Tsuchiya et al.
2007/0104602 A1 5/2007 Ishikawa et al.
2007/0108934 A1 5/2007 Smith et al.
2007/0172373 A1 7/2007 Ni
2007/0231174 A1 10/2007 Ishizuki
2007/0269327 A1 * 11/2007 Qian ..... F04C 23/008 418/55.1
2008/0159888 A1 7/2008 Nakayama et al.
2008/0193311 A1 8/2008 Helies
2008/0206083 A1 8/2008 Suefuji et al.
2009/0148327 A1 6/2009 Carter et al.
2009/0246055 A1 10/2009 Stehouwer et al.
2010/0044320 A1 2/2010 Weber et al.
2010/0111740 A1 5/2010 Ni
2010/0254835 A1 10/2010 Kane et al.
2010/0287954 A1 11/2010 Harman et al.
2011/0129362 A1 6/2011 Kameya et al.
2012/0134862 A1 5/2012 Hockliffe et al.
2012/0240847 A1 9/2012 Neufelder et al.
2013/0149179 A1 6/2013 Sato et al.
2013/0207396 A1 8/2013 Tsuboi
2013/0232975 A1 9/2013 Shaffer et al.
2013/0315765 A1 * 11/2013 Shaffer ..... F04C 25/02 418/5
2014/0023540 A1 1/2014 Heidecker et al.
2014/0260364 A1 9/2014 Litch
2017/0045046 A1 2/2017 Afshari
2017/0051741 A1 2/2017 Shaffer et al.
2017/0067469 A1 3/2017 Malvasi et al.
2017/0074265 A1 3/2017 Asami et al.
2017/0268514 A1 9/2017 Shaffer
2017/0284284 A1 10/2017 Takamiya
2017/0306956 A1 * 10/2017 Monet ..... F04C 18/0269
2017/0321699 A1 11/2017 Kawano et al.
2017/0362962 A1 12/2017 Shaffer et al.
2018/0163725 A1 6/2018 Valdez et al.
2018/0163726 A1 6/2018 Shaffer et al.
2018/0216498 A1 8/2018 Shaffer et al.
2019/0211824 A1 7/2019 Shaffer et al.
2019/0293070 A1 9/2019 Crum et al.
2019/0353162 A1 11/2019 Ishii et al.
2020/0040892 A1 2/2020 Dieckmann et al.
2020/0408201 A1 * 12/2020 Wilson ..... F04C 18/0215

FOREIGN PATENT DOCUMENTS

CN 105402134 3/2016
DE 460936 6/1928
DE 19957425 8/2000
EP 0513824 11/1992
EP 0780576 6/1997
EP 1464838 10/2004
EP 3239526 11/2017

(56) References Cited

FOREIGN PATENT DOCUMENTS

| | | | |
|---|---|---|---|
| GB | 0513827 | 10/1939 | |
| GB | 2002455 | 2/1979 | |
| GB | 1575684 | 9/1980 | |
| JP | S56-019369 | 2/1981 | |
| JP | S57-171002 | 10/1982 | |
| JP | H03-185287 | 8/1991 | |
| JP | H05-157076 | 6/1993 | |
| JP | H07-109981 | 4/1995 | |
| JP | H07-324688 | 12/1995 | |
| JP | H08-261182 | 10/1996 | |
| JP | 2000-213475 | 8/2000 | |
| JP | 2002-13493 | 1/2002 | |
| JP | 2002-227779 | 8/2002 | |
| JP | 2003-343459 | 12/2003 | |
| JP | 2011-012629 | 1/2011 | |
| WO | WO 2004/008829 | 1/2004 | |
| WO | WO 2009/050126 | 4/2009 | |
| WO | WO 2013/121900 | 8/2013 | |
| WO | WO 2015/164453 | 10/2015 | |
| WO | WO-2017089745 A1 * | 6/2017 | ..... F04C 18/0253 |

OTHER PUBLICATIONS

"Involute," Wikipedia, last modified Jun. 2, 2012, 5 pages [retrieved online from: en.wikipedia.org/wiki/Involute].
"Oldham Coupler," Wikipedia, last modified, Feb. 9, 2010, 2 pages [retrieved online from: en.wikipedia.org/wiki/Oldham_coupler].
"Organic Rankine Cycle," Wikipedia, last modified May 19, 2013, 4 pages [retrieved online from: en.wikipedia.org/wiki/Organic_Rankine_Cycle].
"Rankine Cycle," Wikipedia, last modified Apr. 29, 2013, 4 pages [retrieved online from: en.wikipedia.org/wiki/Rankine_cycle].
"Scroll Compressor," Wikipedia, last modified Apr. 24, 2013, 3 pages [retrieved online from: en.wikipedia.org/wiki/Scroll_compressor].
"Thrust Bearing," Wikipedia, last modified Dec. 19, 2012, 2 pages [retrieved online from: en.wikipedia.org/wiki/Thrust_bearing].
International Search Report and Written Opinion for Interiantional (PCT) Patent Application No. PCT/US2018/064427, dated Feb. 5, 2019 14 pages.
International Search Report for International (PCT) Patent Application No. PCT/US01/43523, dated Jun. 5, 2002 1 page.
International Search Report for International (PCT) Patent Application No. PCT/US01/50377, dated May 13, 2002 1 page.
Partial Search Report for European Patent Application No. 13003663.5, dated May 28, 2014 5 pages.
Extended Search Report for European Patent Application No. 13003663.5, dated Sep. 3, 2014 11 pages.
International Search Report and Written Opinion for International (PCT) Patent Application No. PCT/US14/00076, dated Dec. 17, 2014 6 pages.
International Search Report and Written Opinion for International (PCT) Patent Application No. PCT/US18/00118, dated Sep. 24, 2018 19 pages.
Official Action for U.S. Appl. No. 11/703,585, dated Dec. 18, 2009 7 pages.
Official Action for U.S. Appl. No. 11/703,585, dated Jul. 20, 2010 7 pages.
Notice of Allowance for U.S. Appl. No. 11/703,585, dated Feb. 4, 2011 4 pages.
Official Action for U.S. Appl. No. 12/930,140, dated Jan. 14, 2013 22 pages.
Official Action for U.S. Appl. No. 12/930,140, dated Jun. 13, 2013 21 pages.
Notice of Allowance for U.S. Appl. No. 12/930,140, dated Oct. 24, 2013 12 pages.
Official Action for U.S. Appl. No. 13/066,261, dated Feb. 11, 2013 5 pages Restriction Requirement.
Notice of Allowance for U.S. Appl. No. 13/066,261, dated Apr. 4, 2013 13 pages.
Official Action for U.S. Appl. No. 13/987,486, dated Dec. 16, 2013 5 pages Restriction Requirement.
Official Action for U.S. Appl. No. 13/987,486, dated Apr. 23, 2014 13 pages.
Official Action for U.S. Appl. No. 13/987,486, dated Oct. 20, 2014 11 pages.
Notice of Allowance for U.S. Appl. No. 13/987,486, dated Jan. 5, 2015 5 pages.
Corrected Notice of Allowance for U.S. Appl. No. 13/987,486, dated Feb. 20, 2015 8 pages.
Official Action for U.S. Appl. No. 14/544,874, dated Dec. 23, 2016 5 pages Restriction Requirement.
Official Action for U.S. Appl. No. 14/544,874, dated Jan. 26, 2017 9 pages.
Official Action for U.S. Appl. No. 14/544,874, dated Jul. 21, 2017 6 pages.
Notice of Allowance for U.S. Appl. No. 14/544,874, dated Sep. 28, 2017 5 pages.
Official Action for U.S. Appl. No. 15/330,223, dated Nov. 15, 2017 6 pages Restriction Requirement.
Official Action for U.S. Appl. No. 15/330,223, dated Feb. 7, 2018 10 pages.
Official Action for U.S. Appl. No. 15/330,223, dated Aug. 7, 2018 10 pages.
Official Action for U.S. Appl. No. 15/330,223, dated Jan. 11, 2019 14 pages.
Official Action for U.S. Appl. No. 14/507,779, dated Apr. 8, 2014 17 pages.
Official Action for U.S. Appl. No. 13/507,779, dated Dec. 1, 2014 17 pages.
Notice of Allowance for U.S. Appl. No. 14/507,779, dated Mar. 6, 2015 8 pages.
Official Action for U.S. Appl. No. 13/986,349, dated Jan. 21, 2015 25 pages.
Official Action for U.S. Appl. No. 13/986,349, dated Aug. 12, 2015 20 pages.
Official Action for U.S. Appl. No. 14/756,594, dated Mar. 29, 2017 13 pages.
Notice of Allowance for U.S. Appl. No. 14/756,594, dated Jun. 5, 2017 8 pages.
Official Action for U.S. Appl. No. 15/731,929, dated Jan. 31, 2019 11 pages.
Official Action for U.S. Appl. No. 14/999,427, dated Oct. 5, 2017 6 pages Restriction Requirement.
Official Action for U.S. Appl. No. 14/999,427, dated Feb. 9, 2018 9 pages.
Notice of Allowance for U.S. Appl. No. 14/999,427, dated Sep. 21, 2018 18 pages.
Official Action for U.S. Appl. No. 15/731,324, dated Feb. 7, 2019 15 pages.
Official Action for U.S. Appl. No. 15/373,979, dated Jan. 29, 2019 12 pages.
"Operating Manual: OM WGZC-2 Water-Cooled Scroll Compressor Chillers," McQuay International, 2010, 102 pages.
"R410A // Hermetic Scroll Compressors," Bitzer, 2016, 12 pages.
"Refrigeration Technologies: scroll-compressor chillers," Misto, last modified Jan. 2013, 7 pages.
Notice of Allowance for U.S. Appl. No. 15/330,223, dated Jan. 23, 2020 10 pages.
Official Action for U.S. Appl. No. 15/932,150, dated Nov. 25, 2019 26 pages.
Official Action for U.S. Appl. No. 15/932,150, dated Mar. 5, 2020 19 pages.
Official Action for U.S. Appl. No. 15/732,593, dated Nov. 14, 2019 7 pages Restriction Requirement.
Official Action for U.S. Appl. No. 15/732,593, dated Feb. 19, 2020 13 pages.
International Preliminary Report on Patentability for International (PCT) Patent Application No. PCT/US18/00118, dated Jun. 11, 2020 13 pages.
Notice of Allowance for U.S. Appl. No. 15/932,150, dated May 14, 2020 9 pages.

(56) References Cited

OTHER PUBLICATIONS

"Digital Scroll Compressor Technology," Wikipedia, 2010, 3 pages [retrieved online from: en.wikipedia.org/wiki/Digital_Scroll_Compressor_Technology].
Official Action for U.S. Appl. No. 15/731,929, dated Jun. 4, 2019 10 pages.
Notice of Allowance for U.S. Appl. No. 15/731,929, dated Aug. 14, 2019 9 pages.
Notice of Allowance for U.S. Appl. No. 15/731,324, dated Aug. 2, 2019 11 pages.
Notice of Allowance for U.S. Appl. No. 15/373,979, dated Apr. 26, 2019 9 pages.
Official Action for U.S. Appl. No. 16/291,984, dated Oct. 26, 2020 12 pages.
International Preliminary Report on Patentability for International (PCT) Patent Application No. PCT/US2018/064427, dated Nov. 19, 2020 8 pages.
Official Action for U.S. Appl. No. 16/275,943, dated Oct. 9, 2020 15 pages.
Notice of Allowance for U.S. Appl. No. 15/732,593, dated Aug. 13, 2020 9 pages.
Official Action with English Translation for Japan Patent Application No. 2020-561761, dated Sep. 21, 2021 6 pages.
Official Action with English Translation for China Patent Application No. 201880077598.0, dated Aug. 12, 2021 13 pages.
Notice of Allowance with English Translation for Japan Patent Application No. 2020-548856, dated Nov. 2, 2021 5 pages.
Official Action for U.S. Appl. No. 16/514,639, dated Nov. 9, 2021 12 pages.
Extended European Search Report for European Patent Application No. 18883031.9, dated May 3, 2021 6 pages.
Official Action with English Translation for Japan Patent Application No. 2020-548856, dated Jun. 29, 2021 10 pages.
Notice of Allowance for U.S. Appl. No. 16/275,943, dated Mar. 22, 2021 12 pages.
Official Action for U.S. Appl. No. 16/514,639, dated Apr. 12, 2021 6 pages Restriction Requirement.
Official Action for U.S. Appl. No. 16/514,639, dated Jul. 9, 2021 11 pages.
Notice of Allowance for U.S. Appl. No. 16/291,984, dated Feb. 26, 2021 13 pages.
Official Action for U.S. Appl. No. 16/400,921, dated Jun. 4, 2021 7 pages Restriction Requirement.

* cited by examiner

LIQUID COOLING OF FIXED AND ORBITING SCROLL COMPRESSOR, EXPANDER OR VACUUM PUMP

CROSS-REFERENCE TO RELATED APPLICATIONS

This application claims the benefit of U.S. Provisional Patent Application Nos. 62/762,437, filed May 4, 2018 and entitled "Scroll Type Device Having Liquid Cooling Through Flexible Tubing," and 62/700,767, filed Jul. 19, 2018 and entitled "Liquid Cooling of Fixed and Orbiting Scroll Compressor, Expander or Vacuum Pump," the entirety of both of which is hereby incorporated by reference herein for all purposes.

FIELD

The present disclosure relates to scroll devices such as compressors, expanders, or vacuum pumps, and more particularly to scroll devices with liquid cooling.

BACKGROUND

Scroll devices have been used as compressors, expanders, pumps, and vacuum pumps for many years. In general, they have been limited to a single stage of compression (or expansion) due to the complexity of two or more stages. In a single stage scroll vacuum pump, a spiral involute or scroll orbits within a fixed spiral or scroll upon a stationery plate. A motor turns a shaft that causes the orbiting scroll to orbit eccentrically within the fixed scroll. The eccentric orbit forces a gas through and out of pockets created between the orbiting scroll and the fixed scroll, thus creating a vacuum in a container in fluid communication with the scroll device. An expander operates with the same principle, but with expanding gas causing the orbiting scroll to orbit in reverse and, in some embodiments, to drive a generator. When referring to compressors, it is understood that a vacuum pump can be substituted for a compressor and that an expander can be an alternate usage when the scrolls operate in reverse from an expanding gas.

Scroll type compressors and vacuum pumps generate heat as part of the compression or pumping process. The higher the pressure ratio, the higher the temperature of the compressed fluid. In order to keep the compressor hardware to a reasonable temperature, the compressor must be cooled or damage to the hardware may occur. In some cases, cooling is accomplished by blowing cool ambient air over the compressor components. On the other hand, scroll type expanders experience a drop in temperature due to the expansion of the working fluid, which reduces overall power output. As a result, scroll type expanders may be insulated to limit the temperature drop and corresponding decrease in power output.

SUMMARY

Existing scroll devices suffer from various drawbacks. In some cases, such as in tight installations or where there is too much heat to be dissipated, air cooling of a scroll device may not be effective. In semi-hermetic or hermetic applications, air cooling of a scroll device may not be an option. The use of a liquid to cool a scroll device may be beneficial because liquid has a much higher heat transfer coefficient than air. In the case of scroll expanders, the use of a liquid to heat the scroll expander may be beneficial for the same reason.

Oil-free scroll devices are not typically used for high pressure applications due to temperature limitations. Heat generated from the compression process is transferred to the bearings which are negatively impacted by high temperatures.

Current liquid-cooled scroll devices only cool the fixed scroll due to the challenges of transferring coolant to the orbiting scroll.

Scroll devices use a crankshaft bearing that is located on the back side of the orbiting scroll. This is the hottest area of a scroll compressor and the heat often leads to bearing failure in high pressure applications.

Scroll devices require oil when a small scroll mesh gap is used to prevent scroll contact and gauging. When a larger scroll mesh gap is used, compressor performance is decreased due to gas leakage.

Embodiments of the present disclosure include a scroll device that utilizes liquid cooling of both the fixed and orbiting scroll, allowing the scroll device to operate at higher pressures while reducing the risks of premature scroll failure due to high temperature and of contact between the fixed and orbiting scroll due to dimensional changes resulting from high temperatures.

Embodiments of the present disclosure include a scroll device that uses one or more flexible conduits, such as flexible tubes, hoses, or bellows, for transferring coolant, wherein the one or more flexible conduits are oriented substantially perpendicularly to an orbital axis of an orbiting scroll of the scroll device.

Embodiments of the present disclosure also include a method of applying a coating to an involute of a fixed or orbiting scroll.

Embodiments of the present disclosure also include a scroll device that comprises a motor coolant jacket or other coolant retention device for extracting heat from a motor and/or drive bearing(s) of the scroll device.

The term "scroll device" as used herein refers to scroll compressors, scroll vacuum pumps, and similar mechanical devices. The term "scroll device" as used herein also encompasses scroll expanders, with the understanding that scroll expanders absorb heat rather than generating heat, such that the various aspects and elements described herein for cooling scroll devices other than scroll expanders may be used for heating scroll expanders (e.g., using warm liquid).

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. The drawings are not to be construed as limiting the disclosure to only the illustrated and described examples.

DETAILED DESCRIPTION

Before any embodiments of the disclosure are explained in detail, it is to be understood that the disclosure is not limited in its application to the details of construction and the arrangement of components set forth in the following description or illustrated in the figures. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the present disclosure may use examples to illustrate one or more aspects thereof. Unless explicitly stated otherwise, the use or listing of one or more examples (which may be denoted by "for example," "by way of example," "e.g.," "such as," or similar language) is not intended to and does not limit the scope of the present disclosure.

Figure 1:
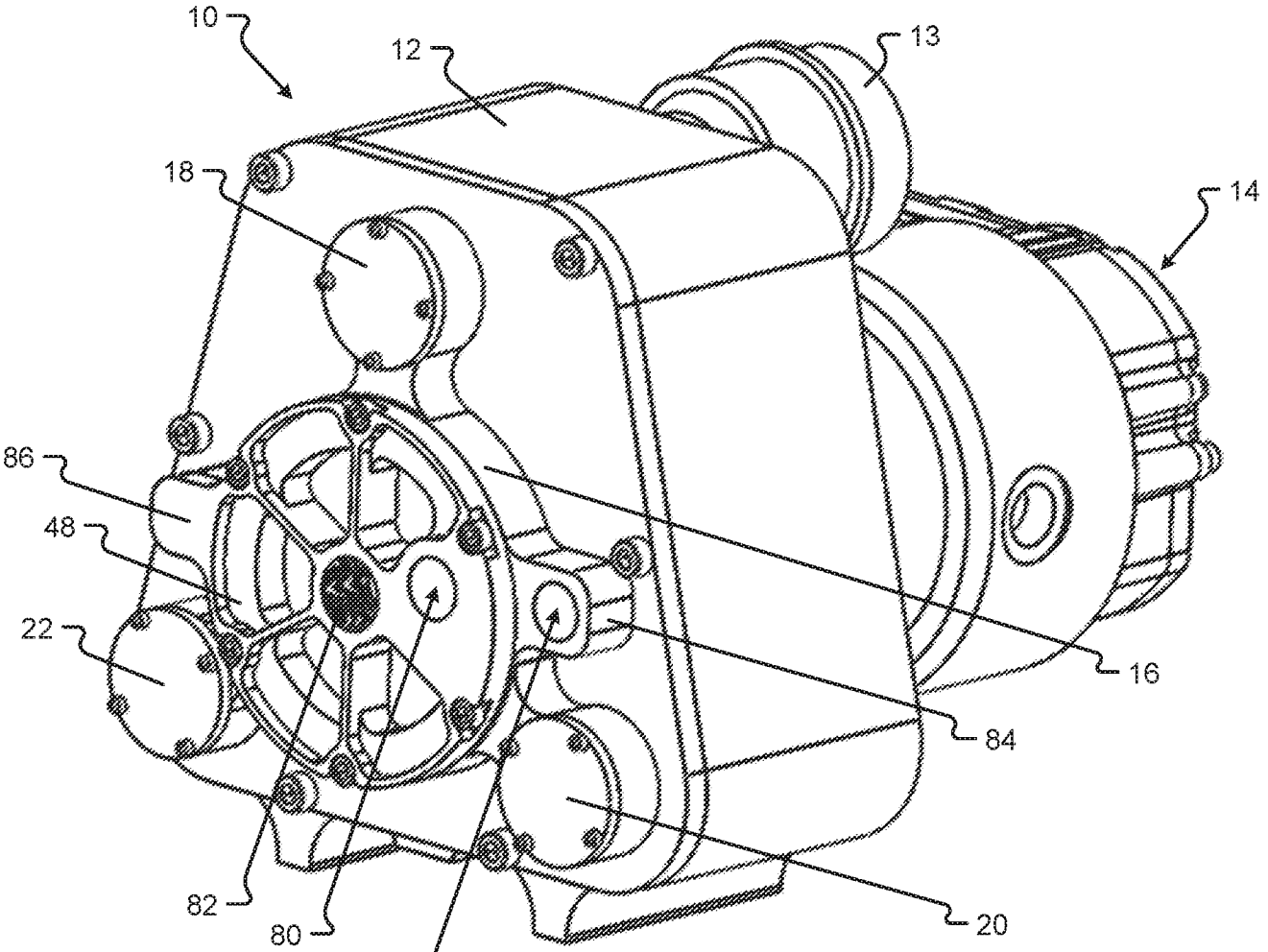
FIG. 1 is a perspective view of a scroll device according to embodiments of the present disclosure.

Referring now to the drawings, wherein like numbers refer to like items, a scroll device 10 according to embodiments of the present disclosure benefits from liquid cooling though use of flexible conduits. In FIG. 1, the scroll device 10 is shown to comprise a housing 12 that is connected to a motor 14. The motor 14 may be an electric motor, or an internal combustion engine. In embodiments where the motor 14 is an electric motor, the motor 14 may be configured to operate on direct current or alternating current. The motor 14 may be a brushed or a brushless motor.

An air filter 13 is operably attached to the housing 12 for filtering air drawn into the housing 12.

Figure 6A:
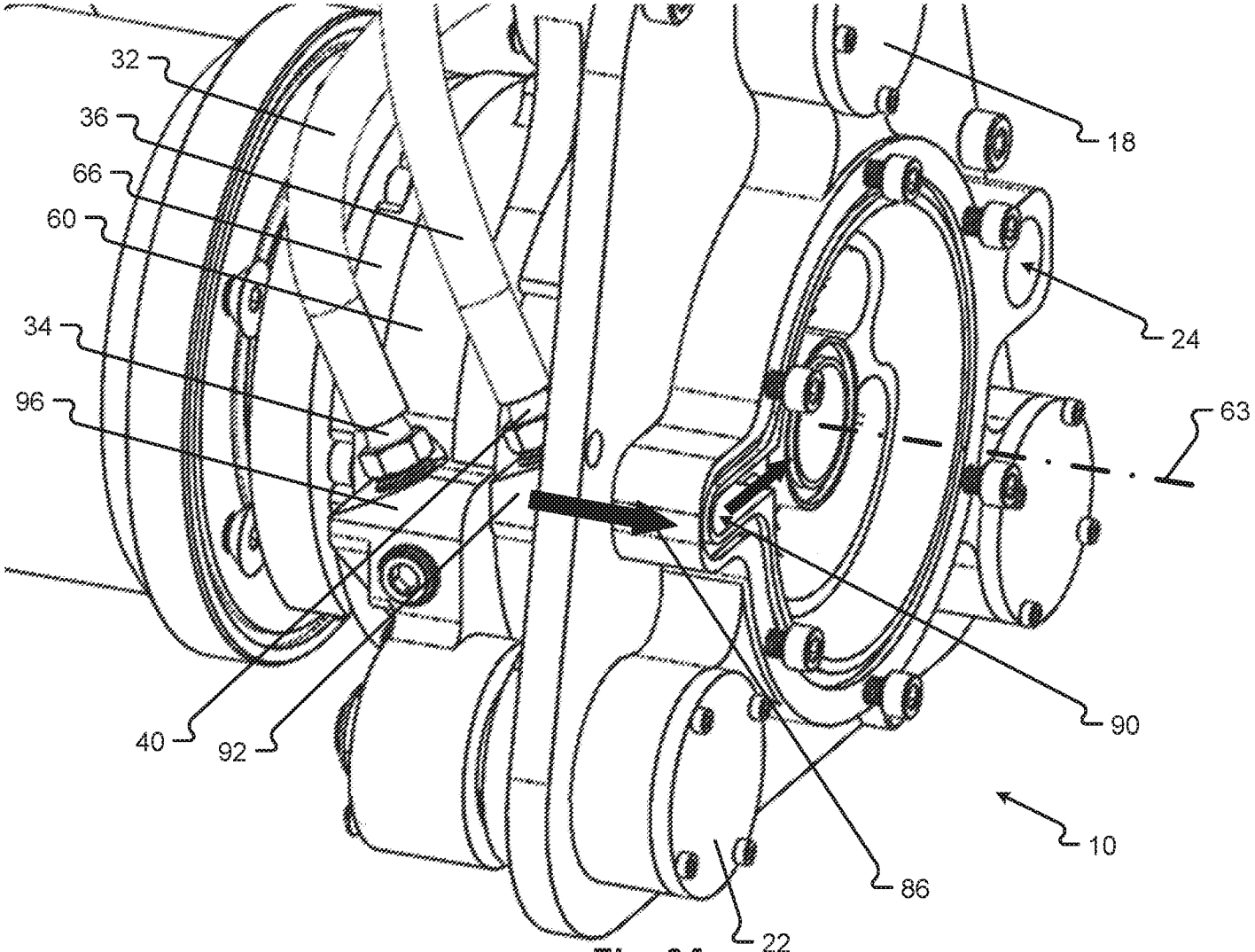
FIG. 6A is a partial perspective view of a scroll device according to embodiments of the present disclosure.
Figure 6B:
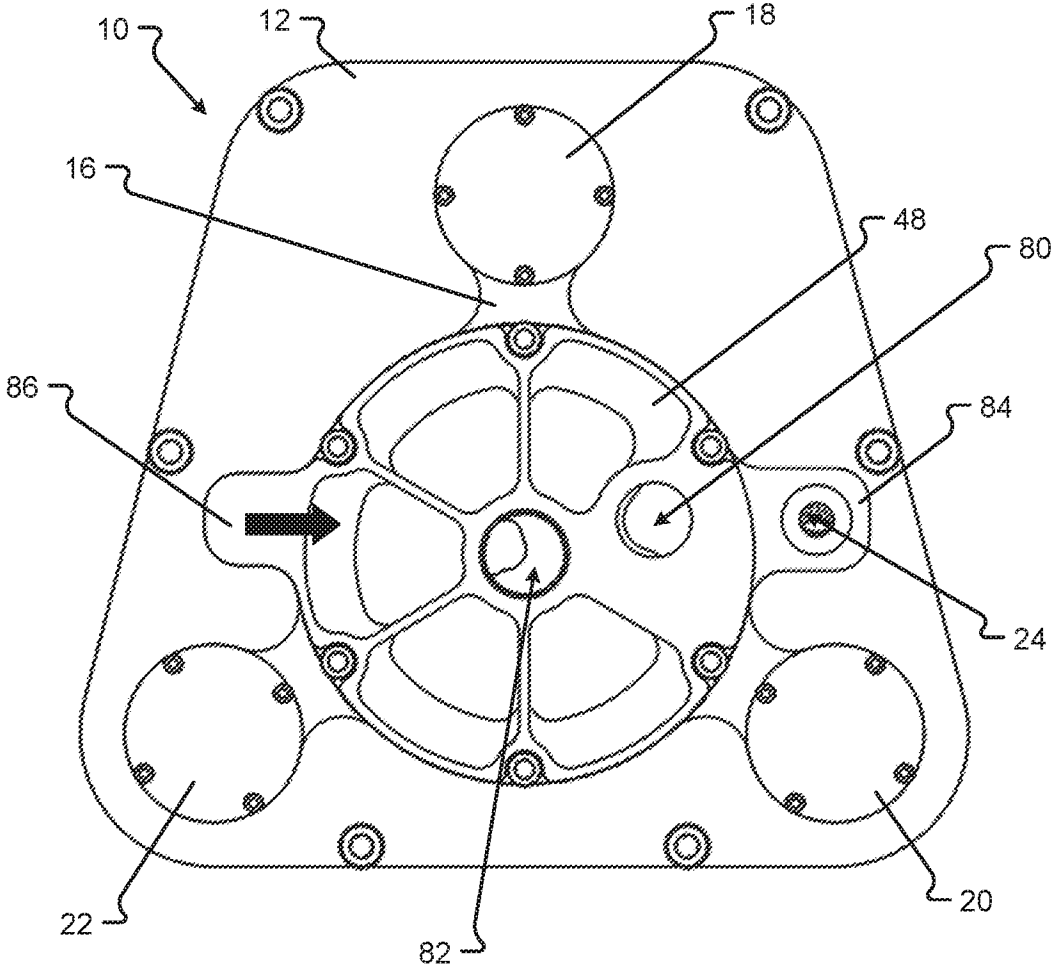
FIG. 6B is an elevational view of a scroll device according to embodiments of the present disclosure.
Figure 7:
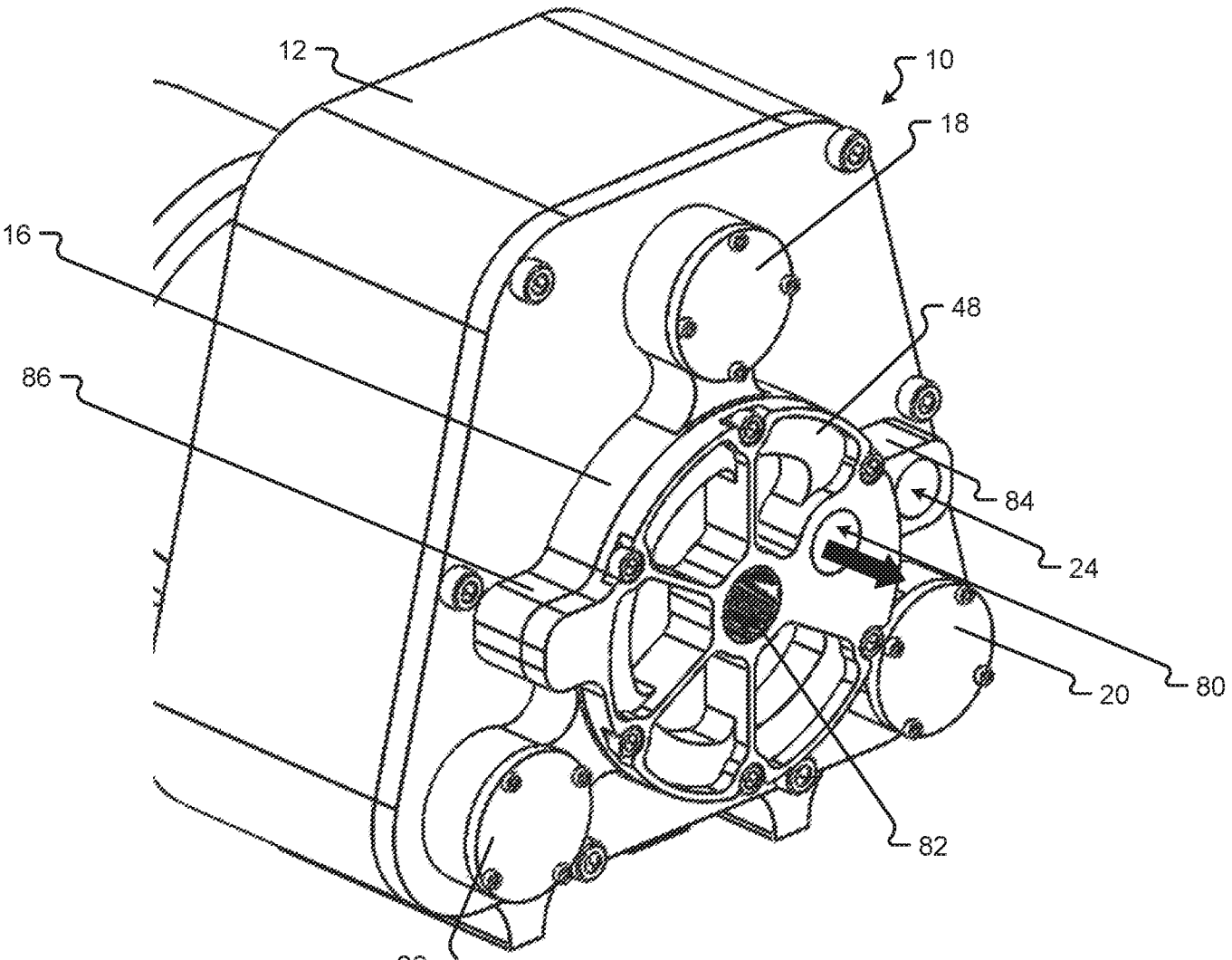
FIG. 7 is a partial perspective view of a scroll device according to embodiments of the present disclosure.

The scroll device 10 comprises a fixed scroll 16. The fixed scroll 16 may be machined or otherwise manufactured from aluminum, steel, or another metal or metal alloy. The fixed scroll 16 comprises a protrusion 84 in which a coolant inlet 24 is provided and through which a cross channel 54 (shown in FIG. 3) extends. A cross hole 90 (shown in FIG. 6A) extends through a protrusion 86 of the fixed scroll 16. A fixed scroll jacket 48 (which may be any coolant retention device suitable for forming a cooling chamber adjacent the fixed scroll 16) is secured to the fixed scroll 16 with a plurality of bolts or other fasteners. A coolant outlet 80 is provided in the fixed scroll jacket 48. An O-ring or other gasket or seal may be provided between the fixed scroll jacket 48 and the fixed scroll 16. The fixed scroll 16 comprises an involute positioned on a side opposite the fixed scroll jacket and extending into the housing 12.

The fixed scroll 16 has three idler shaft assemblies 18, 20, and 22 mounted thereto and spaced approximately 120° apart. Each idler shaft assembly comprises an eccentric idler shaft and at least one bearing (not shown). Although the scroll device 10 is shown as having three idler shaft assemblies, the present disclosure is not limited to scroll devices having exactly three idler shaft assemblies. A scroll device according to some embodiments of the present disclosure may have more or fewer than three idler shaft assemblies.

Moreover, the present disclosure is not limited to the use of idler shaft assemblies to link the fixed scroll 16 and the orbiting scroll 60. An Oldham ring and/or any other mechanical coupling configured to ensure proper orbital motion of the orbiting scroll 60 relative to the fixed scroll 16 may be used instead of the idler shafts 18, 20, and 22.

During operation of the scroll device 10, fresh coolant enters the scroll device 10 via the coolant inlet 24, and heated coolant is discharged through the coolant outlet 80. As used herein, coolant may be, for example, water, antifreeze, polyalkylene glycol, other glycol solutions, refrigerant, oil, or any other heat-transfer fluid. A port 82 serves as a working fluid discharge port for scroll compressors and vacuum pumps, or as a working fluid intake port for scroll expanders.

Figure 2:
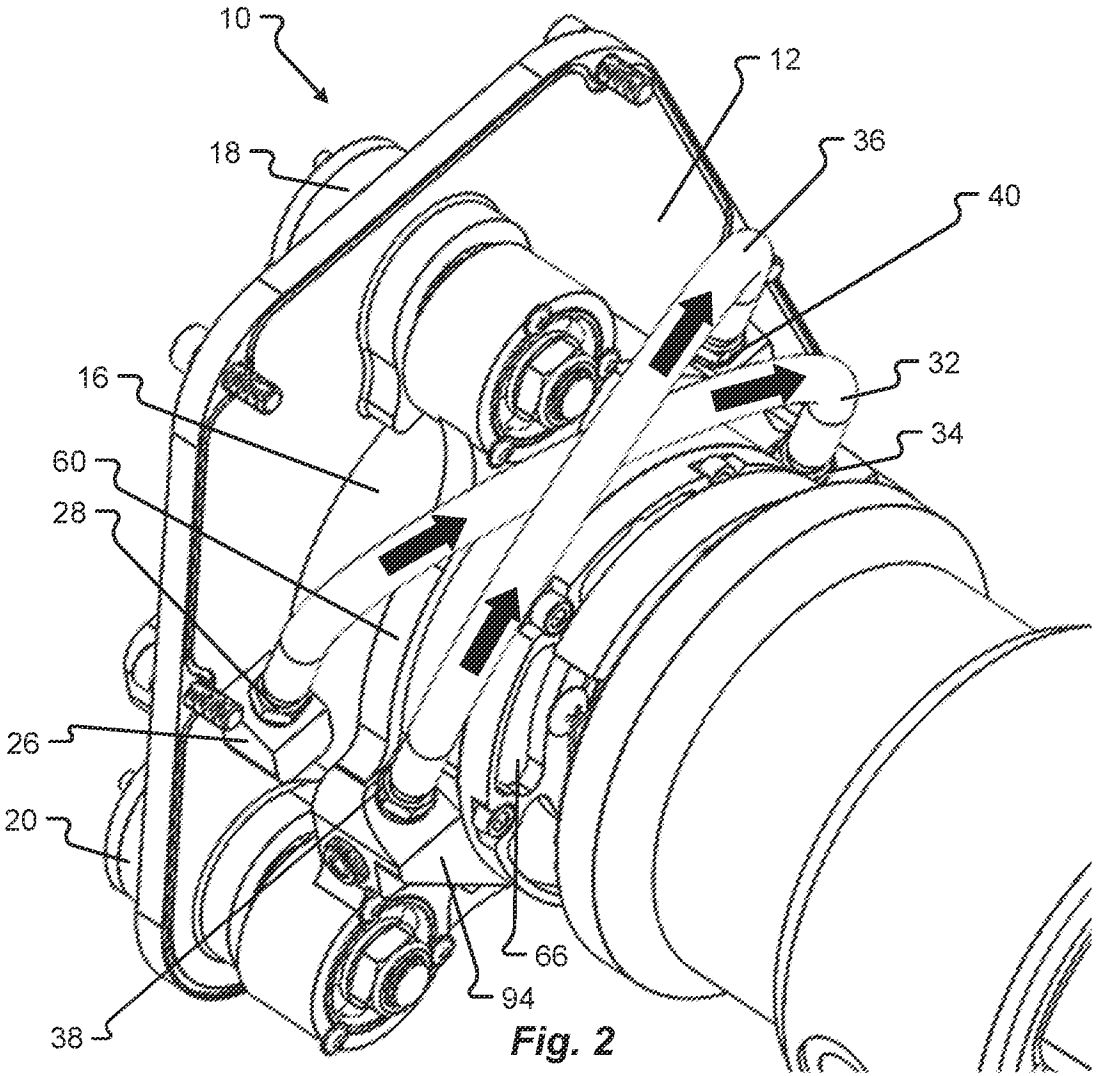
FIG. 2 is a partial perspective view of a scroll device according to embodiments of the present disclosure.

FIG. 2 depicts a perspective view of the scroll device 10 with a portion of the housing 12 removed for clarity. An orbiting scroll 60 is mounted to the idler shaft assemblies 18, 20, and 22. The eccentric idler shafts of the idler shaft assemblies 18, 20, and 22 enable the orbiting scroll 60 to orbit relative to the fixed scroll 16. The orbiting scroll 60 may be machined or otherwise manufactured from aluminum, steel, or another metal or metal alloy. An orbiting scroll jacket 66 (which may be any coolant retention device suitable for forming a cooling chamber adjacent the orbiting scroll 60) is secured to the orbiting scroll 60. An O-ring or other gasket or seal may be provided between the orbiting scroll jacket 66 and the orbiting scroll 60. The orbiting scroll 60 comprises an involute positioned on a side opposite the orbiting scroll jacket 66 and extending toward the fixed scroll 16. The involute of the orbiting scroll 60 is positioned relative to the involute of the fixed scroll 16 so that an orbiting motion of the orbiting scroll 60 relative to the fixed scroll 16 creates pockets of continuously varying size for compressing or expanding a working fluid therein.

The orbiting scroll jacket 66 may comprise a crankshaft bearing, to which an eccentric crankshaft driven by the motor 14 is operably connected. In this configuration, the motor 14 is in force-transmitting communication with the orbiting scroll 60 via the crankshaft and the orbiting scroll jacket 66.

Figure 4:
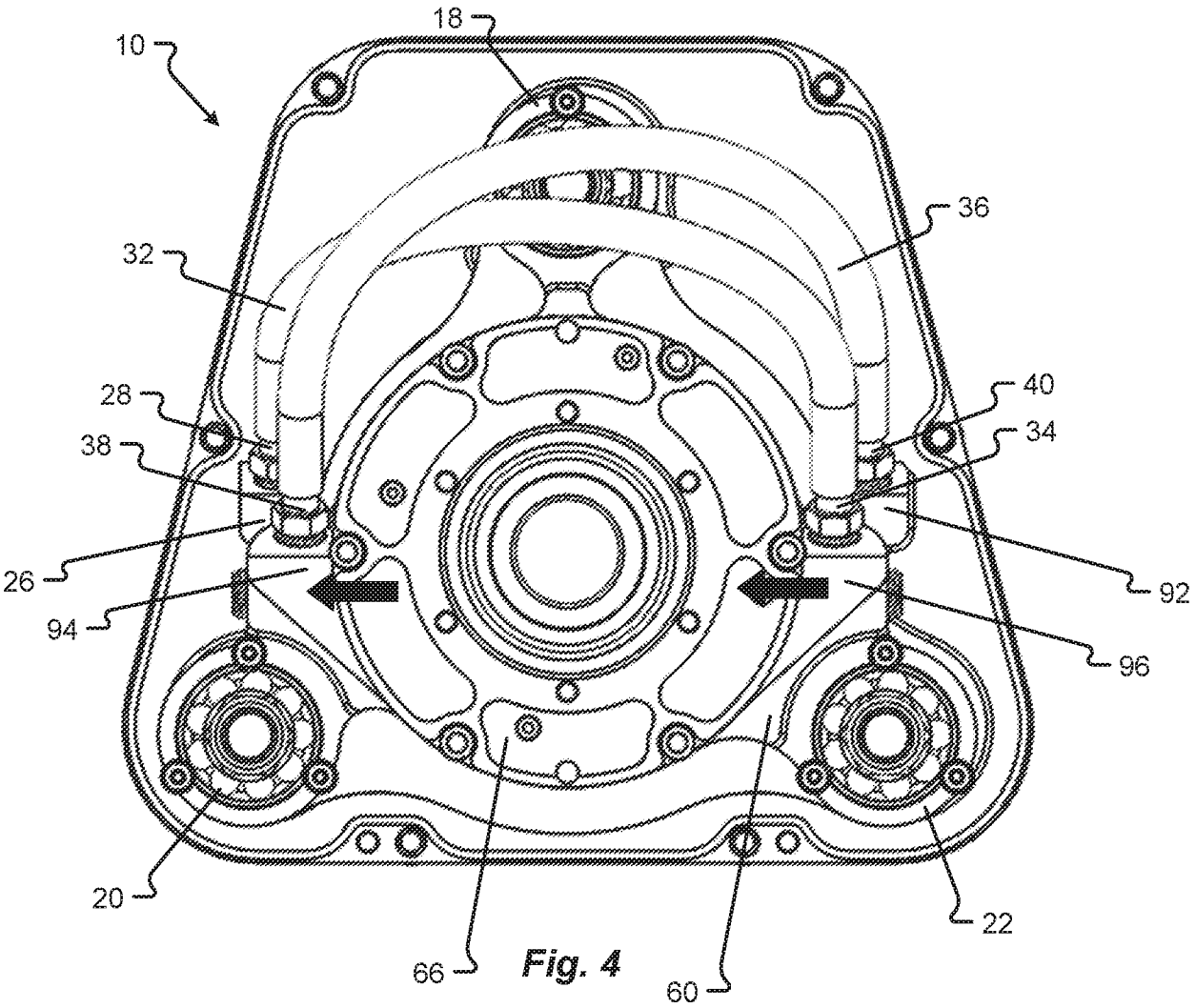
FIG. 4 is an elevational view of a scroll device according to embodiments of the present disclosure.
Figure 5A:
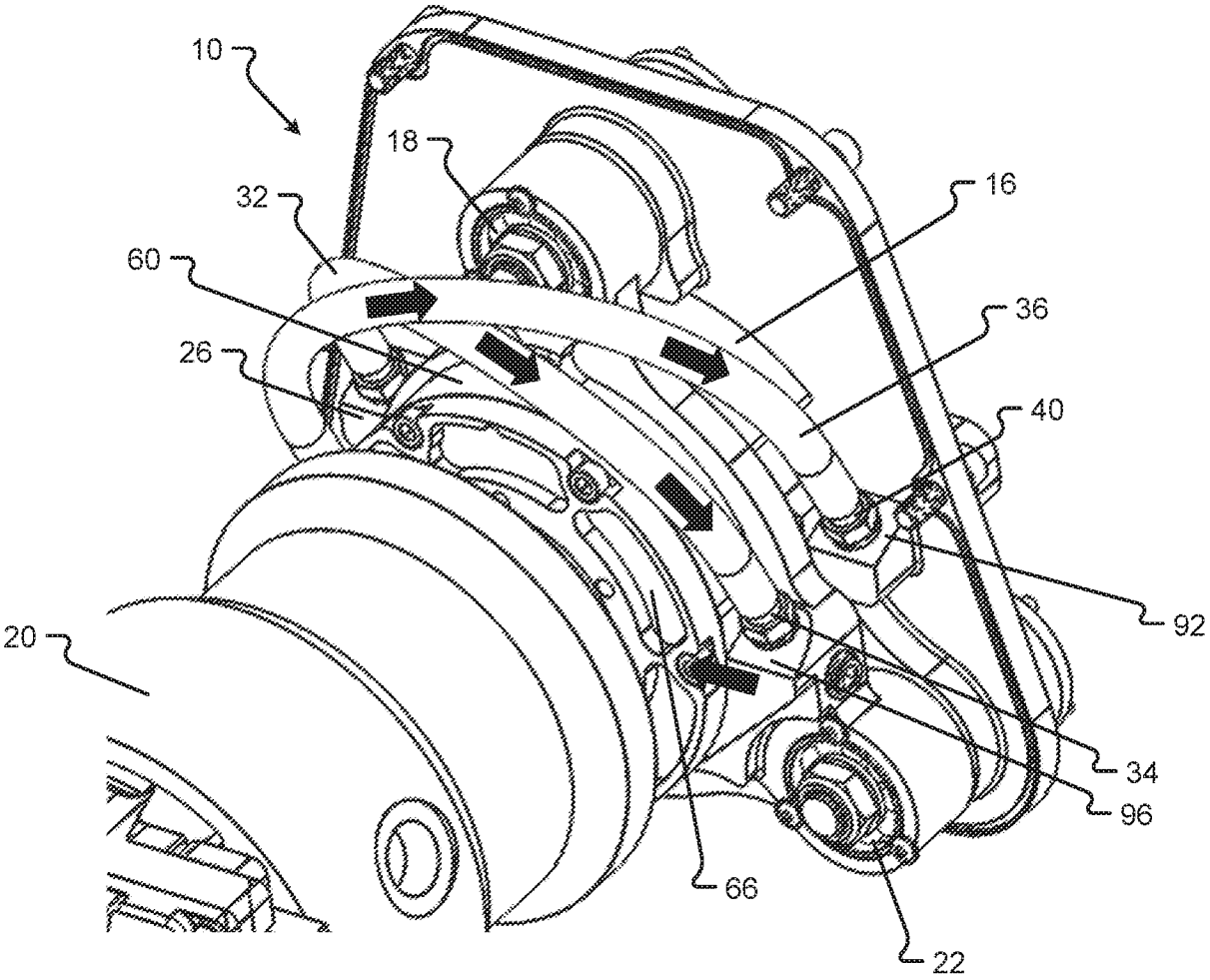
FIG. 5A is a partial perspective view of a scroll device according to embodiments of the present disclosure.
Figure 5B:
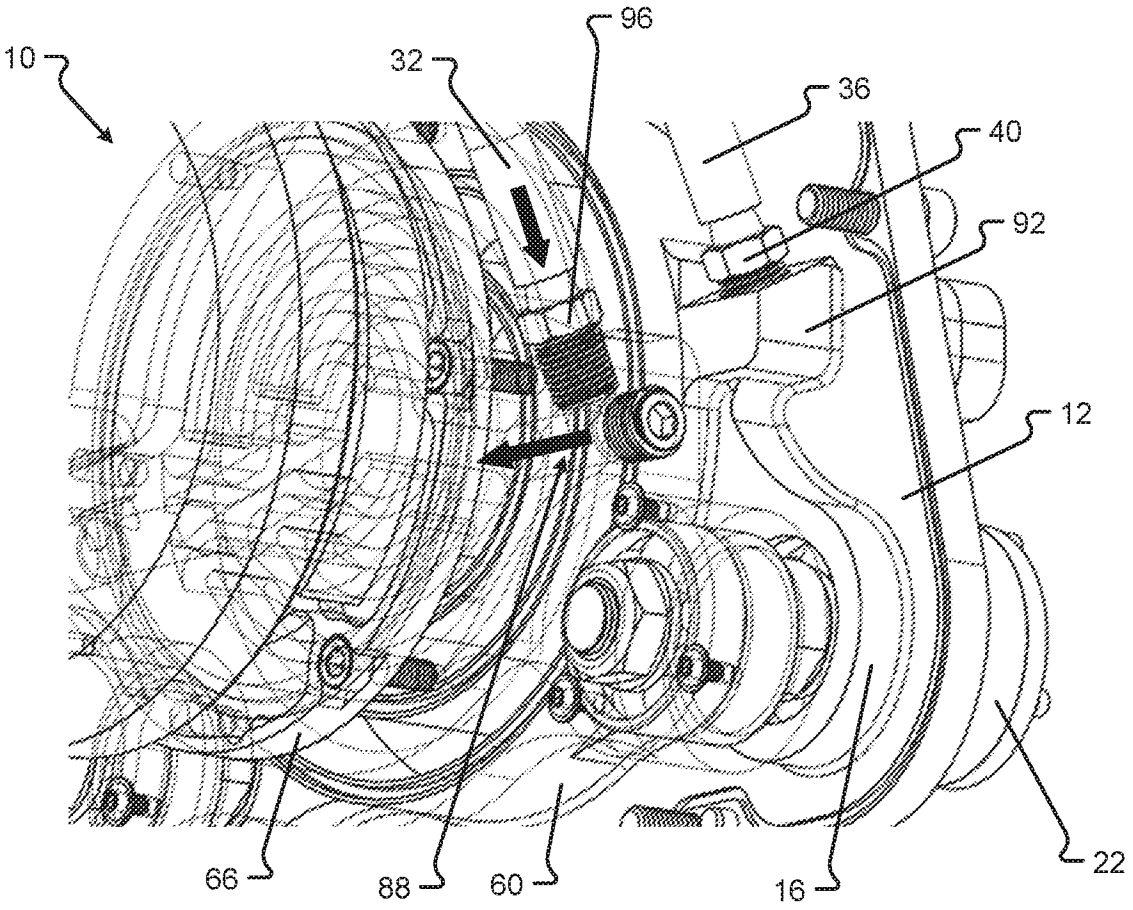
FIG. 5B is a partial perspective view of a scroll device according to embodiments of the present disclosure.

The orbiting scroll 60 also comprises a protrusion 94 in which a cross hole for channeling coolant is provided, and a protrusion 96 (shown in FIG. 4) in which a cross hole 88 (shown in FIG. 5B) is provided.

Also shown in FIG. 2 are other components for transporting fluid through the scroll device 10. A cross channel 54 (shown in FIG. 3) extends through a protrusion 26 as well as the protrusion 84 (shown in FIG. 1), thus providing a path for coolant to flow from the inlet 24 into the housing 12. A barbed hose fitting 28 is fixedly or removably secured to the block 26 in fluid communication with the cross channel 54. Another barbed hose fitting 38 is fixedly or removably secured to a block 94 on the orbiting scroll 60. A first end of a flexible conduit 32 (which may be, for example, a flexible tube, a flexible hose, or a flexible bellows) is fixedly or removably secured to the barbed hose fitting 28 on a first side of the scroll device 10, and a second end of the flexible conduit 32 is fixedly or removably secured to a barbed hose fitting 34 on a second side of the scroll device 10. The flexible conduit 32 channels fluid received via the inlet 24 to the orbiting scroll 60, and more specifically to a cooling chamber formed between the orbiting scroll 60 and the orbiting scroll jacket 66. A first end of another flexible conduit 36 is fixedly or removably secured to the barbed hose fitting 38 on the first side of the scroll device 10, and a second end of the flexible conduit 36 is fixedly or removably secured to a barbed hose fitting 40 on the second side of the scroll device 10. The flexible conduit 36 channels fluid from the orbiting scroll 60 to the fixed scroll 16. Pinch hose clamps or similar clamps may be used to secure the ends of the flexible conduits 32 and 36 to the barbed hose fittings 28, 34, 38, and 40, respectively.

The flexible conduits 32 and 36 may be positioned perpendicular (or substantially perpendicular, or at least at an obtuse angle) to the orbital axis 63 (shown in FIG. 6A) of the orbiting scroll 60. The orbital axis 63 extends longitudinally relative to the scroll device 10 (e.g. from one end to another end of the scroll device 10). The flexible conduits 32 and 36 may curve around the orbital axis 63. The flexible conduits 32 and 36 may cross from one side of the orbital axis 63 to an opposite side thereof. In this configuration, the flexible conduits 32 and 36 are subject to bending motion when the scroll device 10 is running (e.g., because the flexible conduits 32 and 36 are connected at one end to a stationary portion of the scroll device 10, and at another end to an orbiting portion of the scroll device 10). In contrast, if liquid coolant tubes were positioned substantially parallel to the orbital axis 63 (and still connected at one end to a stationary portion of a scroll device and at another end to an orbiting portion of the scroll device), then the tubes would be subject to torsional loading during operation of the scroll device. Additionally, the flexible conduits 32 and 36 are provided with an extended length to reduce force concentrations therein. For example, in some embodiments the flexible conduits 32 and 36 may be about 10% longer than the minimum length needed to reach between the barbed hose fittings to which the flexible conduits 32 and 36 are attached. In other embodiments, the flexible conduits 32 and 36 may be about 20% longer than the minimum length required, and in still other embodiments the flexible conduits 32 and 36 may be between about 30% and about 50% longer than the minimum length required. The configuration of the flexible conduits 32 and 36, angled to the orbital axis 63 and with an extended length, beneficially increases the useful life of the flexible conduits 32 and 36 by reducing or eliminating torsional loading as well as concentrated bending stresses.

In some embodiments, the flexible conduits 32 and/or 36 may be provided with a spiral, spring-like, or coiled shape. The use of such a shape increases the overall length of the flexible conduit, thus beneficially reducing force concentrations.

The flexible conduits 32 and 36 can withstand high cycle fatigue and continual bending stress. The flexible conduits 32 and 36 may be tubes or hoses, and may be made of or comprise, for example, rubber, plastic, fabric, metal, or any combination thereof. The flexible conduits 32 and 36 may be made of one or more composite or fiber-reinforced materials. The flexible conduits 32 and 36 may be subject to one or more treatments during manufacture thereof to improve the properties thereof. For example, in embodiments of the present disclosure using flexible conduits 32 and 36 made or comprised of rubber, the rubber contained in the flexible conduits 32 and/or 36 may be vulcanized rubber. In some embodiments, a scroll device as described herein may utilize a conduit that comprises multiple rigid sections pivotably or rotatably connected to each other, rather than a flexible conduit.

In some embodiments of the present disclosure, one or both of the flexible conduits 32 and 36 may be flexible bellows. The flexible bellows may be made of metal, plastic, or any other material, which material may be selected, for example, based on the temperature of the coolant to be channeled through the flexible bellows, the pressure of the coolant to be channeled through the flexible bellows, and/or the chemical composition of the coolant to be channeled through the flexible bellows.

The fixed scroll jacket 48 and the fixed scroll 16 form a first cooling chamber through which coolant may be channeled to cool the fixed scroll 16, while the orbiting scroll jacket 66 and the orbiting scroll 60 form a second cooling chamber through which coolant may be channeled to cool the orbiting scroll 60. The first cooling chamber is positioned opposite the involute of the fixed scroll 16, and the second cooling chamber is positioned opposite the involute of the orbiting scroll 60. In the scroll device 10, the fixed scroll jacket 48 defines a wall of the first cooling chamber of the fixed scroll 16 and the orbiting scroll jacket 66 defines a wall of the second cooling chamber of the orbiting scroll 60.

In some embodiments, the fixed scroll jacket and/or the orbiting scroll jacket may define more or less of the boundaries of the first and second cooling chambers, respectively, than the fixed scroll jacket 48 and/or the orbiting scroll jacket 66. The fixed scroll jacket 48 and the orbiting scroll jacket 66 are not limited to the shape or form shown in the figures of this application, but may be any coolant retention device in any suitable shape or form. Additionally, in some embodiments either or both of the fixed scroll 16 and the orbiting scroll 60 may comprise a cooling chamber therein that does not require the use of a fixed scroll jacket 48 and an orbiting scroll jacket 66, respectively.

The cooling chamber formed between the fixed scroll 16 and the fixed scroll jacket 48, and the cooling chamber formed between the orbiting scroll 60 and the orbiting scroll 66, may have a cylindrical volume in some embodiments and a non-cylindrical volume in others. In some embodiments, one or both of the cooling chambers may comprise a passageway that channels coolant from an inlet thereof to an outlet thereof. Also in some embodiments, the cooling chambers may be defined entirely by the fixed scroll 16 and/or by the orbiting scroll 60, without the use of a fixed scroll jacket or an orbiting scroll jacket, respectively, or of any other coolant retention device.

An O-ring or other gasket or seal may be provided between the fixed and orbiting scrolls 16 and 60 and the fixed and orbiting scroll jackets 48 and 66, respectively, to reduce leakage of coolant from the cooling chamber.

The flexible conduit 32 enables transfer of liquid coolant received via the inlet 24 to the the orbiting scroll 60, and more specifically to the cooling chamber formed between the orbiting scroll 60 and the orbiting scroll jacket 66. The flexible conduit 36 enables transfer of liquid coolant from the orbiting scroll 60 to the fixed scroll 16, and more specifically to the cooling chamber formed between the fixed scroll 16 and the fixed scroll jacket 48.

In FIG. 2 and throughout the drawings, arrows (other than on lead lines) represent the flow of liquid coolant relative to the scroll device 10 and/or the various components of the scroll device 10.

Figure 3:
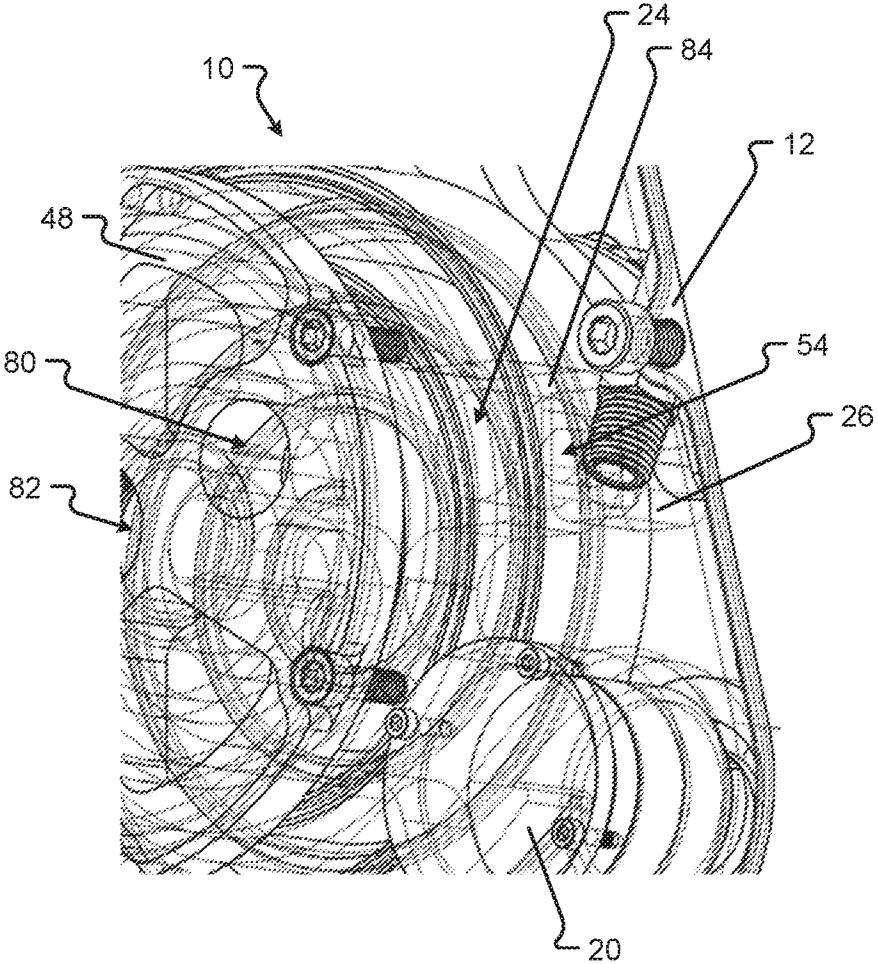
FIG. 3 is a partial perspective view of a scroll device according to embodiments of the present disclosure.

FIG. 3 provides a close-up view of the inlet 24 and surrounding areas of the scroll device 10, with portions of the scroll device 10 shown in phantom to enable visualization of aspects thereof. As shown in FIG. 3, a cross channel 54 extends through the protrusions 84 and 26, thus providing a channel for liquid coolant received via the inlet 24 to pass through the housing 12 and into the flexible conduit 32 (shown in FIG. 2) via the barbed hose fitting 28 (also shown in FIG. 2). Heat generated by operation of the scroll device 10 transfers to the coolant as the coolant flows through the cross channel 54. In some embodiments, the inlet 24 and cross channel 54 may be positioned on the opposite side of the fixed scroll 16, with the inlet machined into or otherwise provided in the protrusion 86 (shown in FIG. 1) instead of the protrusion 84. Indeed, in some embodiments the inlet 24 may be positioned anywhere on the fixed scroll 16 that does not interfere with operation of the scroll device 10, provided that associated components of the scroll device 10 (including, for example, the protrusions 84 or 86 and 26 and the cross channel 54) are configured to channel coolant received via the inlet 24 into a cooling chamber of the fixed scroll 16 or into one of the flexible conduits 32 and 36.

With reference to FIGS. 1-3 generally, although not shown in detail in the figures, the orbiting scroll 60 is driven by the motor 14 via an eccentric center shaft. Balance weights may be used to on the orbiting scroll 60 and/or on the center shaft to counterbalance the orbital motion of the orbiting scroll 60 and prevent undesirable vibrations of the scroll device 10. The eccentric center shaft may be supported by a front bearing or a pair of front bearings and a rear bearing or a pair of rear bearings. In some embodiments, the bearings and the motor 14 may be mounted in the housing 12, while in other embodiments the motor 14 and/or the bearings may be mounted outside the housing 12. A center line of the idler shafts of the idler shaft assembles 18, 20, and 22 is offset from a center line of the center shaft that drives the orbiting scroll (or, in the case of a scroll expander, that is driven by the orbiting scroll).

As noted above, the orbiting scroll 60 is coupled to a center shaft that moves or orbits the orbiting scroll 60 eccentrically. The orbiting scroll 60 follows a fixed path with respect to the fixed scroll 16, creating a series of crescent-shaped pockets between the involutes of the fixed scroll 16 and the orbiting scroll 60. In embodiments where the scroll device 10 is a scroll compressor, the working fluid moves from one or more inlets at the periphery of the scroll involutes toward a discharge outlet at or near the center of the scroll involutes (e.g., port 82) through increasingly smaller pockets, resulting in compression of the working fluid. Similar principles apply for a scroll vacuum pump and a scroll expander. With respect to scroll expanders, compressed fluid is introduced into a small pocket between the orbiting scroll 60 and the fixed scroll 16 (via, for example, the port 82). The pressure exerted by the compressed fluid pushes on the involute walls with sufficient force to cause the orbiting scroll 60 to orbit relative to the fixed scroll 16, which in turn allows the compressed fluid to expand. The orbiting scroll of a scroll expander may be operatively coupled to a generator (e.g., via an eccentric center shaft) so as to convert the kinetic energy of the orbiting scroll into electrical energy.

Referring now to FIGS. 3-7, the flow of liquid coolant through the scroll device 10 according to one embodiment of the present disclosure will be described. Once coolant enters the scroll device 10 via the coolant inlet 24 and traverses the housing 12 through the cross channel 54, the coolant passes through the barbed hose fitting 28 and into the flexible conduit 32. The flexible conduit 32, which bends around the center axes of the fixed scroll 16 and of the orbiting scroll 60 (and thus around the orbital axis 63 of the orbiting scroll 60), and which may remain substantially perpendicular to the center axes and/or the orbital axis, carries the coolant to the orbiting scroll 60. More specifically, the coolant passes through the flexible conduit 32 and the barbed hose fitting 34 into a cross hole 88 in the block 96, which directs the coolant into a cooling chamber between the orbiting scroll 60 and the orbiting scroll jacket 66. Cooling fins within the cooling chamber facilitate the transfer of heat from the orbiting scroll 60 to the coolant, and also direct the coolant through the cooling chamber and into another channel (not shown) in the block 94, which in turn directs the coolant into the flexible conduit 36 via the barbed hose fitting 38. Coolant entering the flexible conduit 36 via the barbed hose fitting 38 is carried to the block 92 via the barbed hose fitting 40. A cross channel (not shown) directs the coolant through the housing 12 and into the block 86, where a cross hole 90 (visible in FIG. 6A, in which the fixed scroll jacket 48 has been removed) channels the coolant into a cooling chamber between the fixed scroll 16 and the fixed scroll jacket 48. As with the orbiting scroll cooling chamber, cooling fins within the fixed scroll cooling chamber facilitate the transfer of heat from the fixed scroll 16 to the coolant. The cooling fins further channel the coolant to the coolant outlet 80, from which point the heated coolant may be transferred to an external heat sink, heat exchanger, or other cooling system where heat may be extracted from the coolant in preparation for recirculation of the coolant through the scroll device 10, or returned to a coolant source or repository, or discarded.

Although FIGS. 3-7 illustrate one possible configuration for routing coolant through a scroll device, the present disclosure encompasses other configurations as well. For example, one or both of the cross-channels 54 and 56 through the housing 12 may, in some embodiments, be located in other positions of the housing 12. Additionally, one or both of the cross-holes 88 and 90 (together with one or more of the protrusions 86, 92, 94, and 96) may be positioned elsewhere on the scroll device. In some embodiments, one or both of the protrusions 94 and 96 may comprise a valve or other access port enabling coolant to be inserted directly into or extracted directly from the coolant channels therein. Similarly, in some embodiments, one or both of the protrusions 84 and 86 may comprise a valve or other access port enabling coolant to be inserted directly into or extracted directly from the coolant channels therein.

Further, a scroll device with liquid cooling such as the scroll device 10 may be configured, in some embodiments, to route coolant from the inlet to the orbiting scroll 60 (including to a cooling chamber associated with the orbiting scroll 60) to the fixed scroll 16 (including to a cooling chamber associated with the fixed scroll 16). In other embodiments, such a scroll device may be configured to route coolant from the inlet to the fixed scroll 16 (including to a cooling chamber associated with the fixed scroll 16) and then to the orbiting scroll 60 (including to a cooling chamber associated with the orbiting scroll 60). In still further embodiments, coolant may be routed only to the orbiting scroll 16 (including to a cooling chamber associated with the orbiting scroll 60) or only to the fixed scroll 16 (including to a cooling chamber associated with the fixed scroll 16). In some embodiments, for example, the fixed scroll 16 may be liquid cooled, while the orbiting scroll 60 may be air cooled. In other embodiments, the fixed scroll 16 may be air cooled, while the orbiting scroll 60 may be liquid cooled.

Figure 8A:
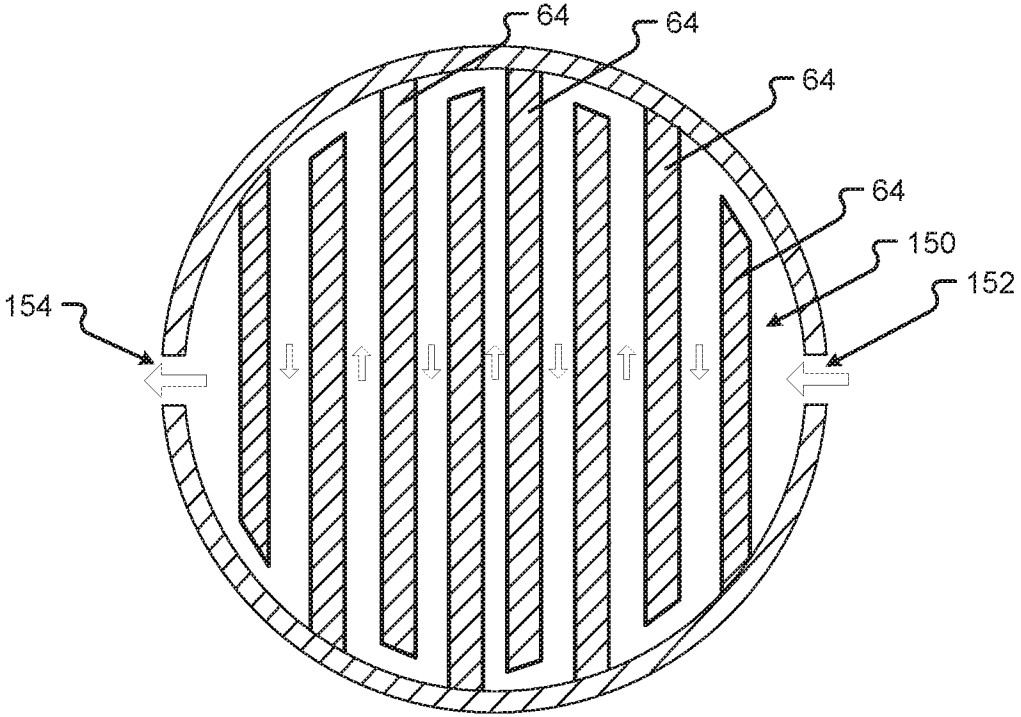
FIG. 8A is a cross-sectional view of a portion of a scroll device according to embodiments of the present disclosure.

FIG. 8A illustrates a cross section of a cooling chamber 150, which is representative of the cooling chamber formed between the orbiting scroll 60 and the orbiting scroll jacket 66 of the scroll device 10, and also demonstrates the principle of operation of the cooling chamber formed between the fixed scroll 16 and the fixed scroll jacket 48 of the scroll device. Coolant flows into the cooling chamber 150 through the inlet 152. Cooling fins 64 direct the coolant through the cooling chamber 152 along a circuitous path that enables the coolant to flow past the cooling fins 64 and extract heat therefrom. The cooling fins route the coolant to the outlet 154, from which point the coolant may be routed to another cooling chamber or to a heat exchanger for cooling the now-heated coolant. Aspects of the cooling fins 64, including, for example, the material of manufacture of the cooling fins, the thickness of the cooling fins, the location of the cooling fins, and/or the surface finish of the cooling fins, may be selected to facilitate heat transfer from the scroll with which the cooling fins 64 are associated (e.g., the fixed scroll or the orbiting scroll) to coolant flowing through the cooling chamber 150.

Although FIG. 8A illustrates one configuration of cooling fins 64, other configurations of cooling fins 64 fall within the scope of the present disclosure. More specifically, in addition to being configured to channel coolant from the inlet 152 to the outlet 154, the cooling fins 64 may be configured to channel more coolant to portions or areas of the cooling chamber 150 adjacent to the hottest parts of the fixed or orbiting scroll on which the cooling chamber 150 is positioned. For example, the cooling fins 64 may be configured to channel more coolant to the center of the cooling chamber 150. Additionally, in some embodiments all of the cooling fins 64 may extend from the fixed or orbiting scroll to the fixed or orbiting scroll jacket, while in other embodiments one or more of the cooling fins 64 may extend only partially from the fixed or orbiting scroll toward the fixed or orbiting scroll jacket. Still further, the cooling fins may be configured to maximize or improve heat transfer from the fixed or orbiting scroll to the coolant flowing through the cooling chamber 150.

While FIG. 8A illustrates a cooling chamber 150 having an inlet 152 on one side and an outlet 154 on an opposite side, in other embodiments the inlet 152 and/or outlet 154 may be positioned elsewhere around the circumference of the cooling chamber 150. In some embodiments, one or both of the inlet and the outlet may be positioned on the jacket that covers the cooling chamber 150.

Figure 8B:
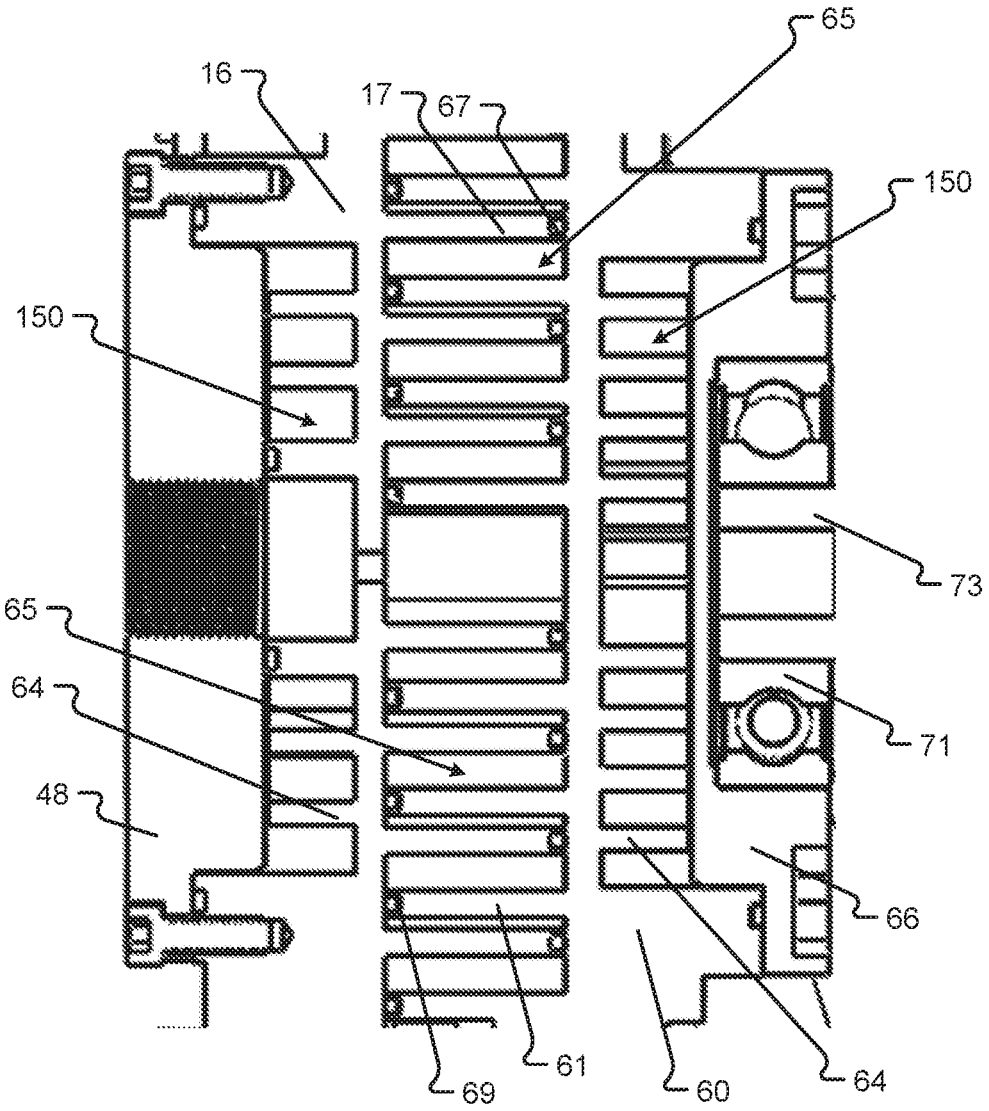
FIG. 8B is a cross-sectional view of another portion of a scroll device according to embodiments of the present disclosure.

FIG. 8B shows a cross-sectional view of a fixed scroll 16 and an orbiting scroll 60 of a scroll device such as the scroll device 10, as well as of a fixed scroll cooling jacket 48 and an orbiting scroll cooling jacket 66. As shown in this view, the fixed scroll involute 17 and the orbiting scroll involute 61 form a plurality of pockets 65, in which a working fluid is compressed (for scroll devices other than scroll expanders) or expanded (for scroll expanders). The fixed scroll involute 17 comprises a tip seal groove in which a tip seal 67 is fitted. The tip seal 67 presses against the orbiting scroll 60 and reduces leakage of working fluid from one pocket 65 to another. The orbiting scroll involute 61 also comprises a tip seal groove in which a tip seal 69 is fitted. The tip seal 69 presses against the fixed scroll 16 and also reduces leakage of working fluid from one pocket 65 to another.

The fixed scroll jacket 48 and the fixed scroll 16, as well as the orbiting scroll jacket 66 and the orbiting scroll 60, each form a cooling chamber 150 therebetween. Cooling fins 64 within the cooling chambers 150 are configured to facilitate heat transfer from the fixed scroll 16 and the orbiting scroll 60 to coolant flowing through the cooling chambers 150. The cooling fins 64 also channel fluid from an inlet to each cooling chamber to an outlet from each cooling chamber.

Also shown in FIG. 8B is a crankshaft bearing 71, which is mounted in the orbiting scroll jacket 66 and is operably connected to one end of an eccentric crankshaft 73. In scroll devices other than scroll expanders, the eccentric crankshaft 73, driven by a motor, causes the orbiting scroll 60 to orbit relative to the fixed scroll 16. In scroll expanders, expansion of the working fluid causes the orbiting scroll 60 to orbit relative to the fixed scroll 16. The eccentric crankshaft 73 is operably connected to a generator, and the orbiting motion of the orbiting scroll causes the eccentric crankshaft 73 to rotate, thus turning the generator to generate electricity.

Figure 9A:
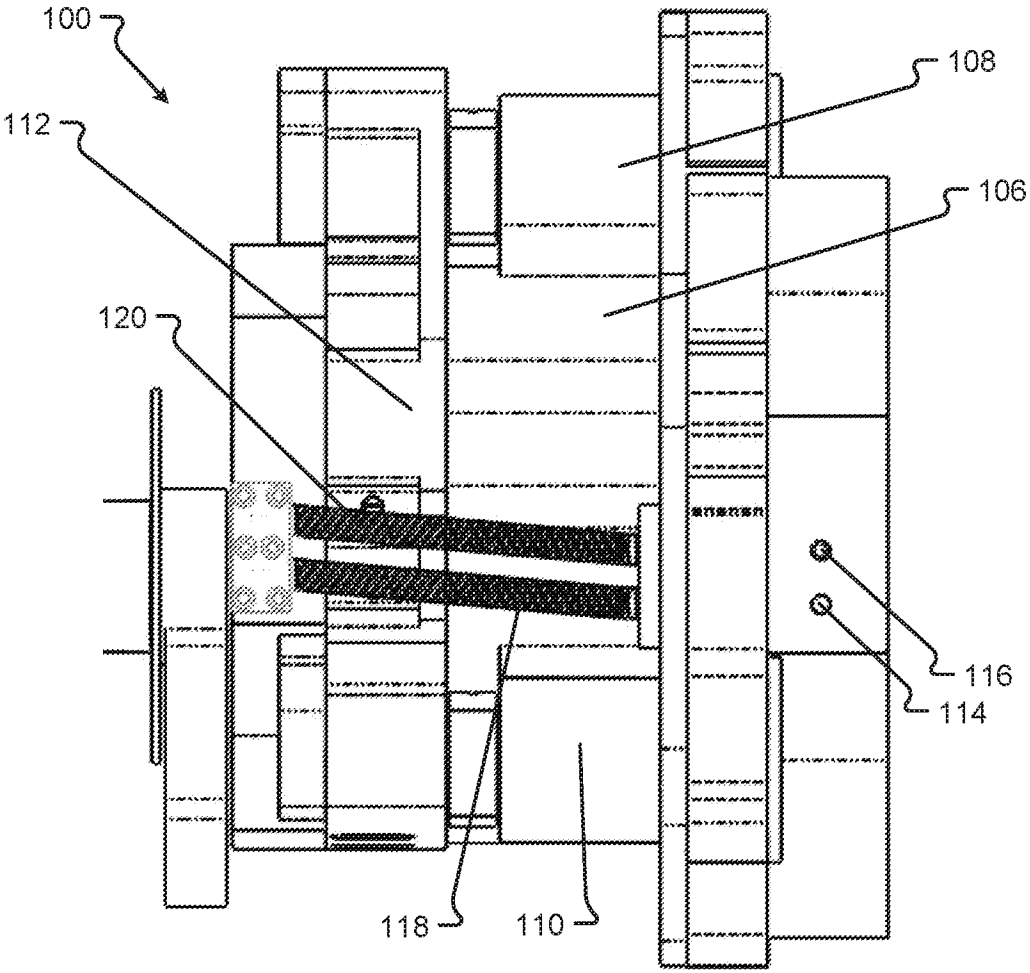
FIG. 9A is an elevational view of a portion of a scroll device according to embodiments of the present disclosure.
Figure 9B:
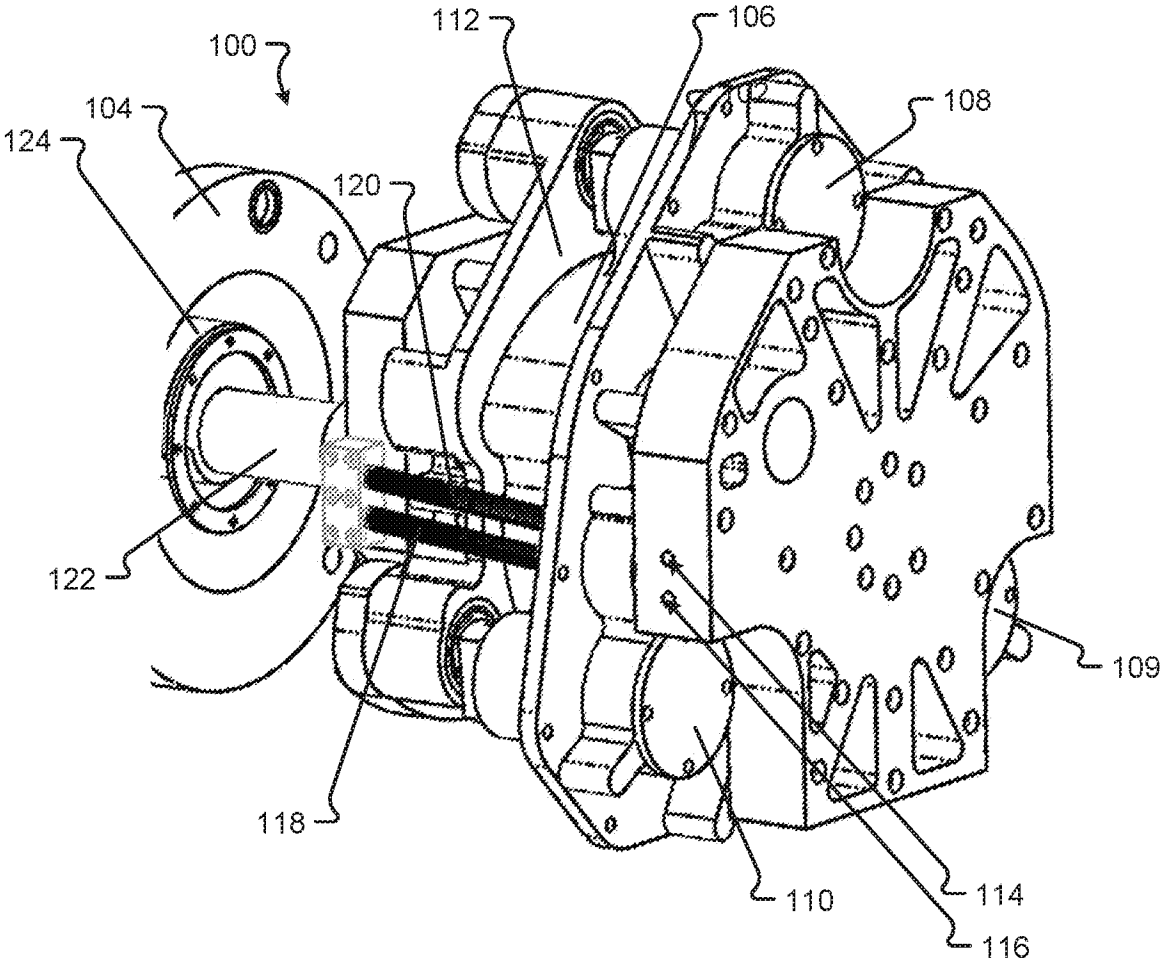
FIG. 9B is a partial perspective view of a scroll device according to embodiments of the present disclosure.

FIGS. 9A and 9B depict a scroll device 100 according to another embodiment of the present disclosure. The scroll device 100 comprises a fixed scroll 106 mated to an orbiting scroll 112, which orbiting scroll 112 is operably connected to a motor 104. The motor 104 may be the same as or similar to the motor 14. The fixed scroll 106, which may be the same as or similar to the fixed scroll 16, has three idler shaft assemblies 108, 109, 110 being spaced approximately 120° apart. The idler shaft assemblies 108, 109, 110 may be the same as or similar to the idler shaft assemblies 18, 20, and 22. As with other embodiments described herein, any mechanical coupling other than the idler shaft assemblies 108, 109, 110 may be used to secure the orbiting scroll 112 to the fixed scroll 106 and to ensure a proper range of the motion of the orbiting scroll 112 relative to the fixed scroll 106. For example, an Oldham ring may be used instead of the idler shaft assemblies 108, 109, 110. The fixed scroll 106 is mated to the orbiting scroll 112 via the idler shafts of the idler shaft assemblies 108, 109, 110. The orbiting scroll 112 may be the same as or similar to the orbiting scroll 60. The idler shafts enable the orbiting scroll 112 to orbit relative to the fixed scroll 106. The scroll device 100 also comprises a center shaft 122 that is connected to the motor 104. The center shaft 122 is supported by a front bearing 124 or a pair of front bearings and a rear bearing (not shown) or a pair of rear bearings. The motor 104 drives the center shaft 122. The orbiting scroll 112 has a first involute and the fixed scroll 106 has a second involute.

In order to balance the rotary motion of the orbiting scroll 112, a pair of balance weights may be positioned co-axially with the first involute to dynamically balance the orbiting scroll 112. Also, a pair of counterweights may be positioned on the center shaft to dynamically balance the orbiting scroll 112. The orbiting scroll 112 is coupled to the center shaft that moves or orbits the orbiting scroll eccentrically, following a fixed path with respect to the fixed scroll 106, creating a series of crescent-shaped pockets between the two scrolls 106 and 112. The scroll device 100 utilizes the same principle of operation as the scroll device 10.

The scroll device 100 comprises an inlet flexible tube or bellows 118 which is connected to a coolant inlet 114, and an outlet flexible tube or bellows 120 which is connected to a coolant outlet 116. Liquid coolant (not shown) may flow into the inlet bellows 118 from the inlet 114 and then into cooling fins (not shown) associated with the orbiting scroll 112 before exiting through the outlet flexible tube or bellows 120 and the coolant outlet 116. In other embodiments, the inlet 114 and flexible tube or bellows 118 may be configured to channel coolant from the inlet 114 through the flexible tube or bellows 118 to cooling fins associated with the fixed scroll 106, and the outlet 116 and flexible tube or bellows 120 may be configured to channel coolant from the fixed scroll 106 through the flexible tube or bellows 120 to the outlet 116. In still other embodiments, the inlet 114 and flexible tube or bellows 118 may be configured to channel coolant from the inlet 114 to cooling fins associated with one of the fixed scroll 106 and the orbiting scroll 112, whereupon another flexible tube or bellows may be configured to channel coolant to the other of the fixed scroll 106 and the orbiting scroll 112, from which the flexible tube or bellows 120 may be configured to channel coolant to the outlet 116. In accordance with embodiments of the present disclosure, a flexible tube or bellows may be used to channel coolant to, from, or in between any one or more of the fixed scroll 106 (including any cooling fins or cooling chambers associated therewith), the orbiting scroll 112 (including any cooling fins or cooling chambers associated therewith), the motor 104 (including any cooling fins or cooling chambers associated therewith), and any other component in need of cooling or through which coolant must be routed to achieve desired cooling of the scroll device 100.

Figure 10:
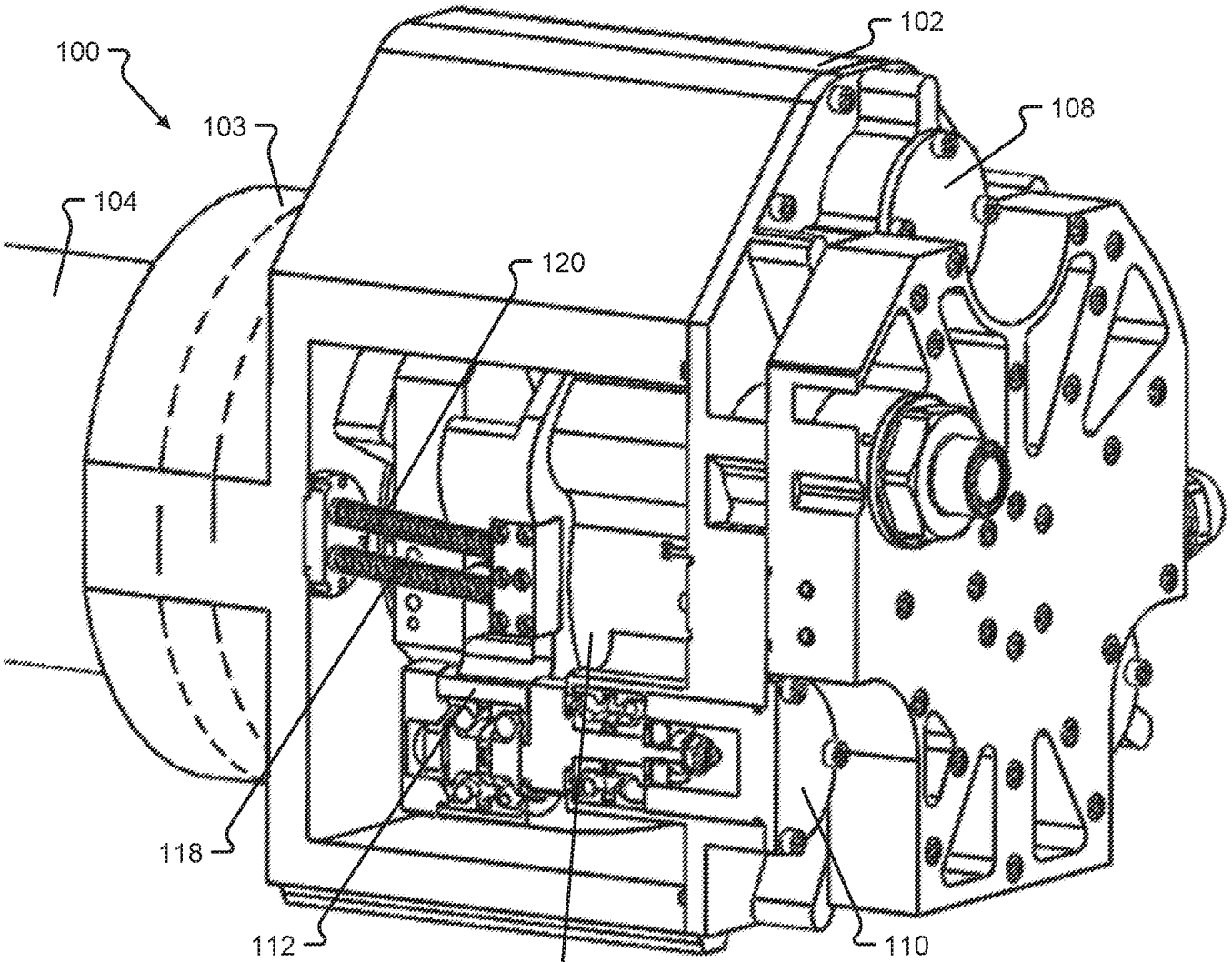
FIG. 10 is a partial perspective view of a scroll device according to embodiments of the present disclosure.

FIG. 10 illustrates an alternative embodiment of a scroll device 100, in which the flexible tubes or bellows 118 and 120 extend away from the fixed scroll 106 and toward the front of the housing 102 instead of toward the rear of the scroll device 100. In this embodiment, the coolant inlet and outlet, although not visible, are positioned on the front of the housing 102.

Torsional stress may accelerate the degradation of flexible tubing. Accordingly, while the present disclosure encompasses the use of either flexible tubing or bellows in the scroll device 100, the use of bellows to channel coolant in the embodiments of FIGS. 9A-9B and 10 may be beneficial given the torsional stresses to which flexible tubing would be subjected if flexible tubing were used in the configuration of the scroll device 100. On the other hand, the bellows may better withstand the stresses and loading resulting from movement of the orbiting scroll 112 relative to the fixed scroll 106, and thus may last longer.

High pressure scroll devices tend to require high power motors to drive them (in the case of scroll compressors and vacuum pumps) or tend to drive high power generators (in the case of scroll expanders). Such devices thus require large motors or generators that may rely on forced conduction with the surrounding environment, which is highly dependent on the surrounding temperatures. In accordance with embodiments of the present disclosure, liquid cooling can also be applied to the motor or generator, allowing a reduction in overall size while maintaining a predictable and consistent motor or generator temperature.

With reference now to FIGS. 11A-11E, a scroll device 200 according to embodiments of the present disclosure, which may be the same as or substantially similar to the scroll device 10, comprises a motor 204, a housing 208, a motor coolant jacket 212, and a coupling 214. The motor coolant jacket 212 comprises a coolant inlet 216 and a coolant outlet 220, and at least partially defines a sealed motor heat sink 224. Coolant pumped into or otherwise received by the coolant inlet 216 flows through the motor heat sink 224, absorbing heat from both the rotor and stator of the motor 204 to reduce the temperature of the motor 204. The coolant then exits the motor coolant jacket 212 via the coolant outlet 220, at which point the coolant can be circulated to external heat exchangers, returned to a coolant source or repository, or discarded.

The motor coolant jacket 212 and/or the motor heat sink 224 may comprise one or more cooling fins.

Figure 11A:
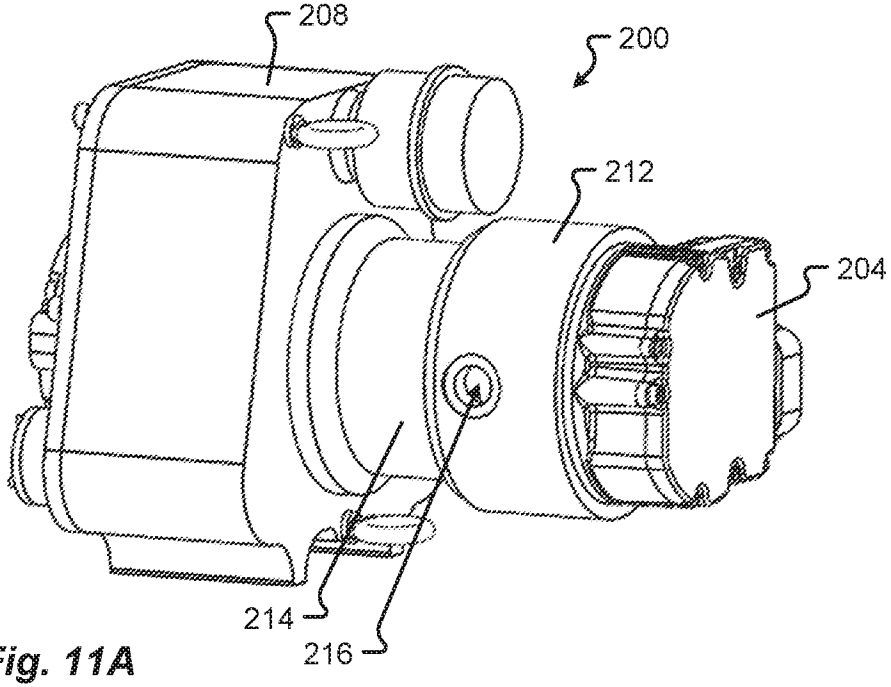
FIG. 11A is a perspective view of a scroll device according to embodiments of the present disclosure.
Figure 11B:
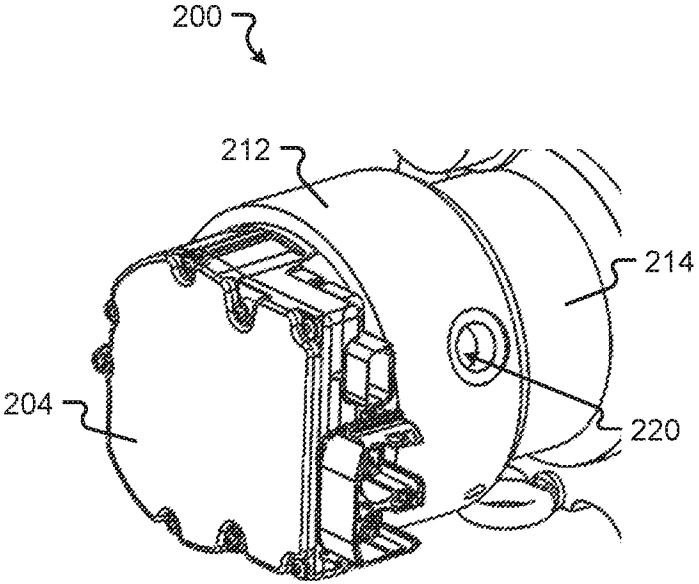
FIG. 11B is a partial perspective view of a scroll device according to embodiments of the present disclosure.
Figure 11D:
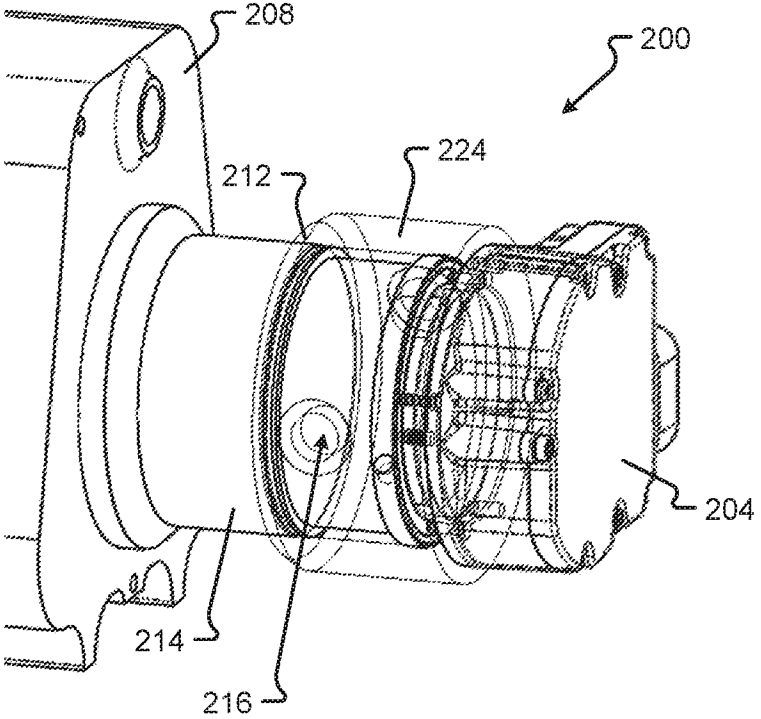
FIG. 11D is a partial perspective view of a scroll device according to embodiments of the present disclosure.
Figure 11C:
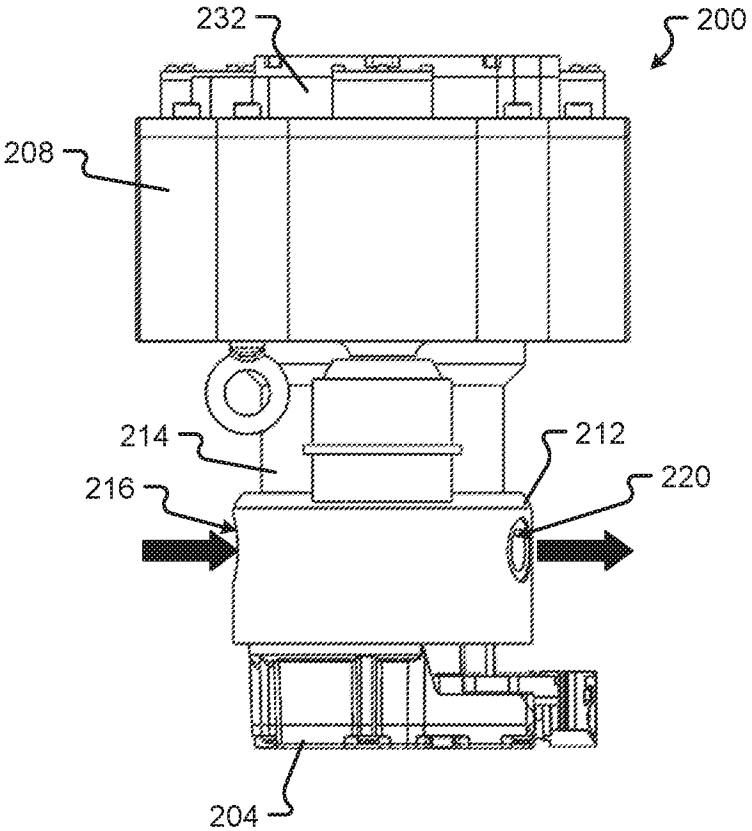
FIG. 11C is a plan view of a scroll device according to embodiments of the present disclosure.
Figure 11E:
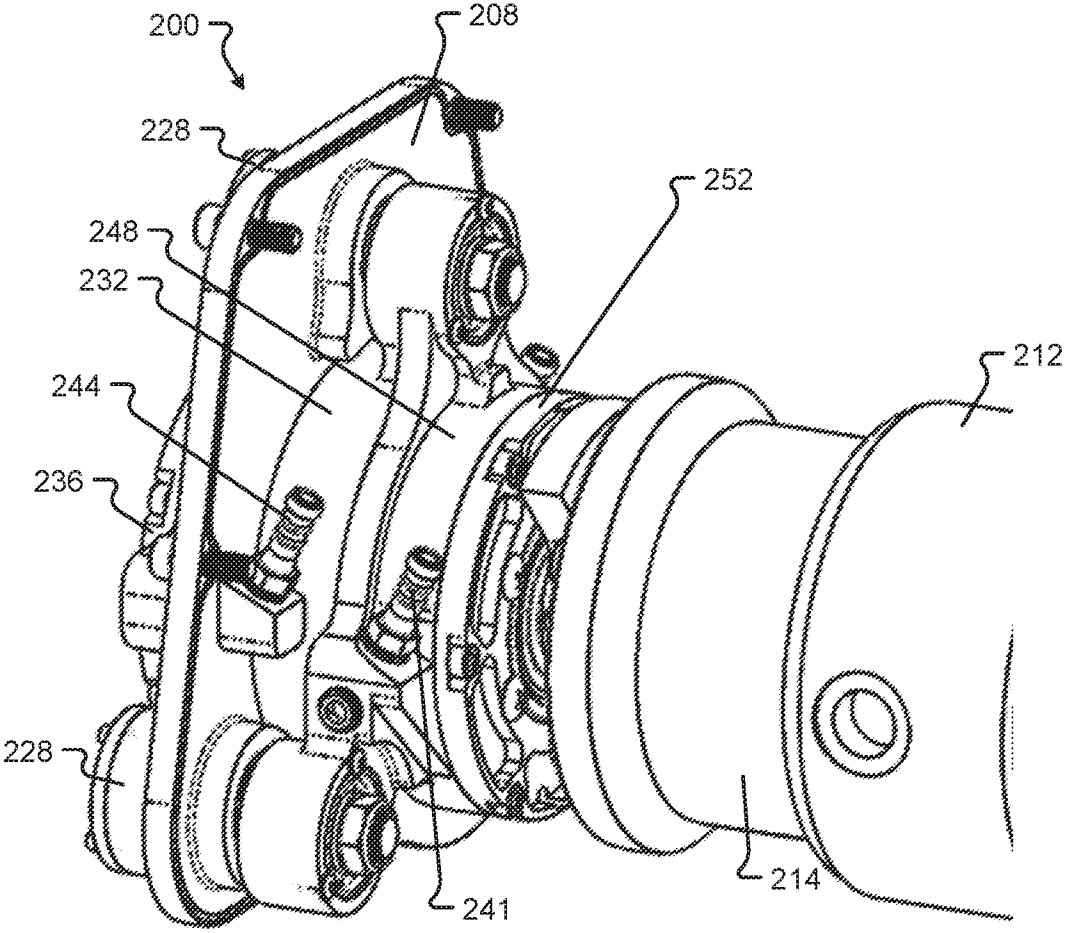
FIG. 11E is a partial perspective view of a scroll device according to embodiments of the present disclosure.

FIG. 11E shows a perspective view of the scroll device 200, wherein a portion of the housing 208 is removed. Visible in FIG. 11E are a fixed scroll 232, as well as two idler shafts 228 spaced 120 degrees from each other (with a third not visible) and a fixed scroll jacket 236. An orbiting scroll 248, an orbiting scroll jacket 252, and barbed hose fittings 241 and 244 are also visible. The barbed hose fitting 241 is in fluid communication with a cooling chamber defined by the orbiting scroll 248 and the orbiting scroll jacket 252. Each of the barbed hose fittings 244 and 241 is adapted to have a flexible conduit secured thereto, for the transfer of coolant from one side of the scroll device 200 to the other side, in the same manner as described elsewhere herein.

Figure 12:
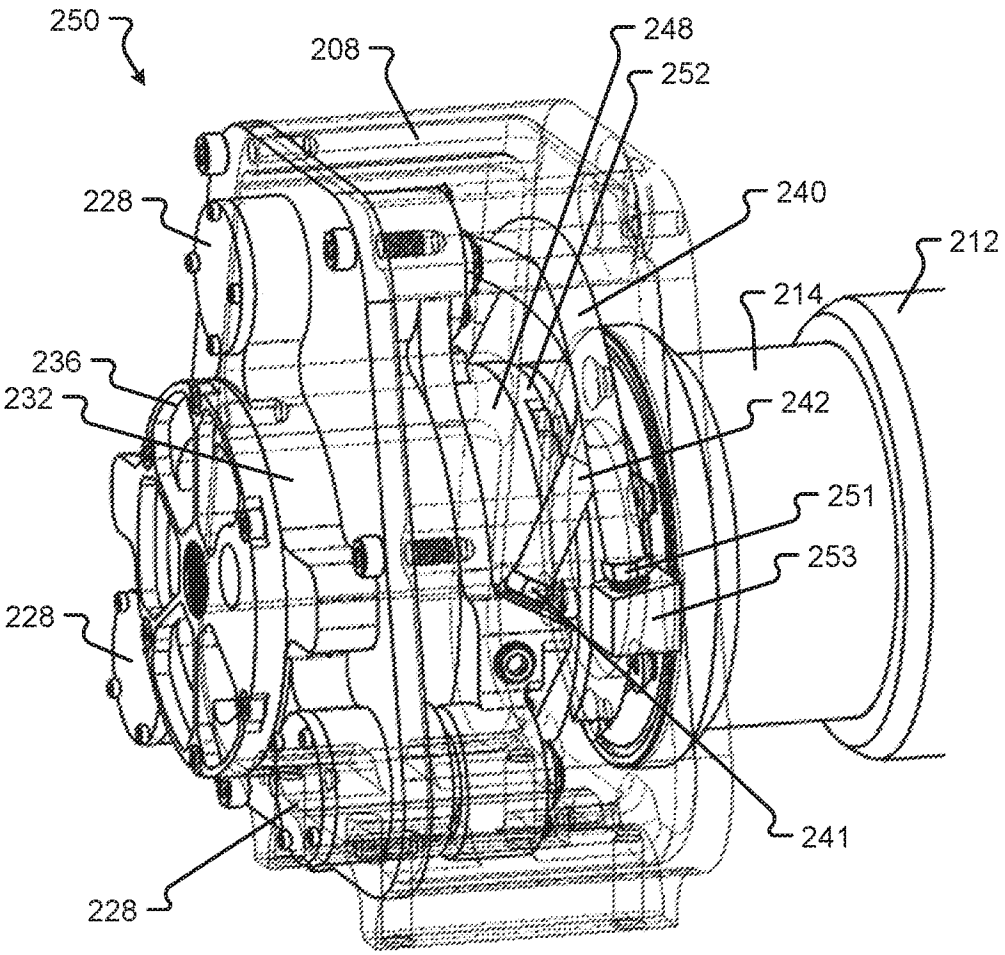
FIG. 12 is a partial perspective view of a scroll device according to embodiments of the present disclosure.

In FIG. 12, in which the housing 208 is shown in phantom, a scroll device 250 is substantially similar to the scroll device 200 of FIGS. 11A-11E, but is configured with a protrusion 253 supporting a barbed hose fitting 251. In this embodiment, the flexible conduit 240 is attached at one end to a barbed hose fitting (not visible) in fluid communication with the cooling chamber formed between the orbiting scroll 248 and the orbiting scroll jacket 252, and at the other end to the barbed hose fitting 251, which is in fluid communication with a coolant channel (not shown) that transfers the coolant to the motor coolant jacket 212, and/or to a motor heat sink such as the motor heat sink 224 (such as that shown in FIG. 11D). This removes the need for external hosing or tubing to transfer coolant from the orbiting scroll 248 (or from the fixed scroll 232) to the motor coolant jacket 212.

Other configurations of the flexible conduits 240 and 242 of the scroll device 250 are possible. The flexible conduits 240 and 242 may be arranged as needed to channel coolant from a coolant inlet, to one or more cooling chambers including a cooling chamber associated with the fixed scroll 232, a cooling chamber associated with the orbiting scroll 248, and a cooling chamber associated with the motor coolant jacket 212.

The components of the scroll device 200 may be the same as or similar to the corresponding components of the scroll device 10.

Figure 13:
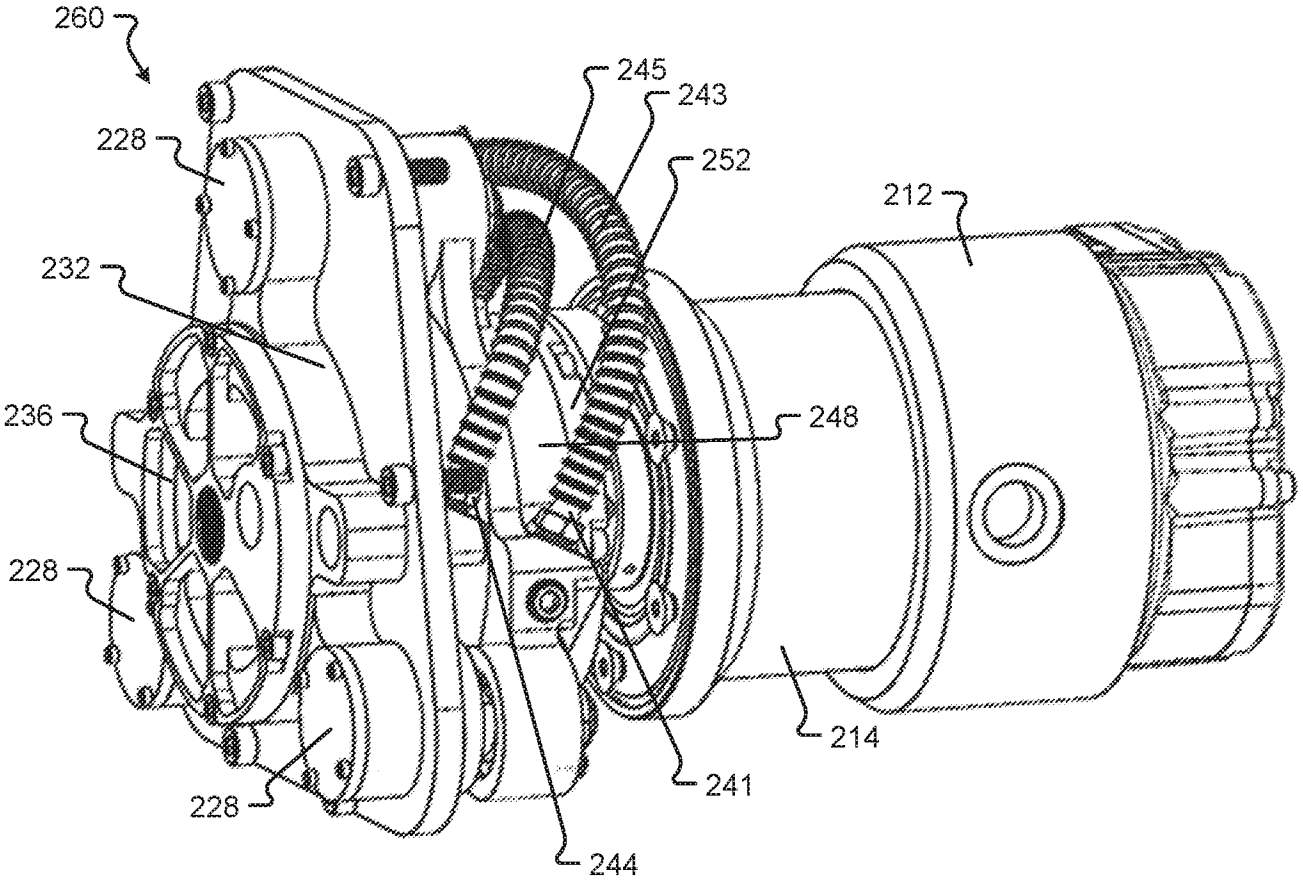
FIG. 13 is a perspective view of a scroll device according to embodiments of the present disclosure.

FIG. 13 provides a perspective view of a scroll device 260, which is similar to the scroll device 200. In the scroll device 260 of FIG. 13, flexible metal bellows 243 and 245 are used instead of flexible conduits 240 and 242. The flexible metal bellows 243 and 245 are shown as being connected to the barbed hose fittings 241 and 244, respectively, so as to route coolant from a coolant inlet 246 through the barbed hose fitting 244 and the flexible metal bellows 245 and into the cooling chamber defined by the orbiting scroll 248 and the orbiting scroll jacket 252. After passing through that cooling chamber, the coolant is routed through the barbed hose fitting 241 and into the flexible metal bellows 243, which routes the coolant toward a cooling chamber defined by the fixed scroll 232 and the fixed scroll jacket 236.

According to the present disclosure, various embodiments of a scroll device such as the scroll device 200 may be configured to route cooling to one or more of the fixed scroll 232, the orbiting scroll 248, and the motor coolant jacket 212, in any order. For example, coolant may be routed to the orbiting scroll 248 and then to the motor coolant jacket 212 before being circulated to an external heat exchanger and then back to the orbiting scroll 248. As another example, coolant may be circulated from the orbiting scroll 248 to the fixed scroll 232 to the motor coolant jacket 212 before being circulated to an external heat exchanger and then back to the orbiting scroll 248. In some embodiments, coolant may be routed to the motor coolant jacket 212 without the use of any external tubes, hoses, bellows, or other conduits, while in other embodiments, coolant may be routed to the motor coolant jacket via a tube, hose, bellows, or other conduit that channels the coolant to the coolant inlet 216. In sum, embodiments of the scroll device 200 may utilize flexible tubes, hoses, bellows, or other conduits to route coolant between or among two or more of a cooling chamber defined by the fixed scroll 232 and the fixed scroll jacket 236, a cooling chamber defined by the orbiting scroll 248 and the orbiting scroll jacket 252, the coolant jacket 212, an external heat exchanger, and/or any other desired location.

Figure 14:
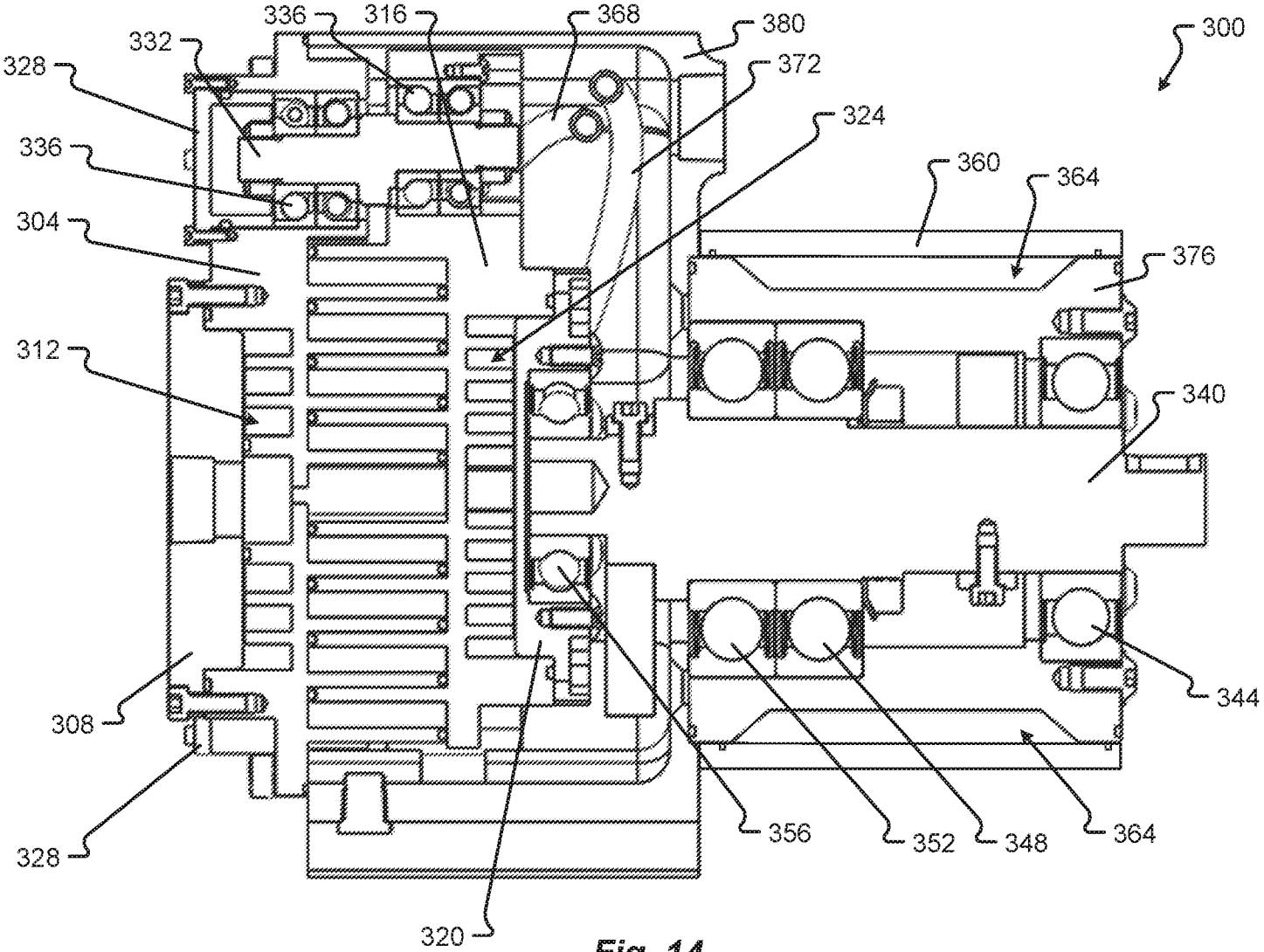
FIG. 14 is a cross-sectional view of a scroll device according to embodiments of the present disclosure.

Turning now to FIG. 14, a scroll device 300 according to embodiments of the present disclosure comprises many components that are the same as or substantially similar to the components of the scroll devices 10, 100, and 200 described elsewhere herein. The scroll device 300 comprises a fixed scroll 304 and a fixed scroll jacket 308 defining a cooling chamber 312; an orbiting scroll 316 and an orbiting scroll jacket 320 defining a cooling chamber 324; a plurality of idler shaft assemblies 328, each comprising an idler shaft 332 supported by a plurality of bearings 336; flexible conduits 368 and 372 for routing coolant between or among two or more of the various cooling chambers of the scroll device 300, an external heat exchanger, and/or any other desired location; a crankshaft 340 for driving the orbiting scroll 316, the center drive shaft 340 supported by a crankshaft bearing 356 in the orbiting scroll jacket 320 as well as a plurality of crankshaft bearings 344, 348, 352 provided in a coupling 376 that extends between a drive motor of the scroll device 300 and a housing 380 of the scroll device 300; and a coupling jacket 360 attached to the coupling 376 and configured to define a cooling chamber 364 between the coupling 376 and the coupling jacket 360. To prevent or reduce the likelihood of coolant leakage from one or more of the cooling chambers 312, 324, and 364, one or more O-rings or other seals or gaskets may be provided between the fixed scroll 304 and the fixed scroll jacket 308; between the orbiting scroll 316 and the orbiting scroll jacket 320; and/or between the coupling 376 and the coupling jacket 360.

As described elsewhere herein, the crankshaft 340 is operably connected (either directly or indirectly, e.g., by a belt or chain) at one end to a motor (not shown), which drives the crankshaft 340. An opposite end of the crankshaft 340 engages the crankshaft bearing 356. The crankshaft 340 is eccentric, which allows the crankshaft 340 to drive the orbiting scroll 316 (via the crankshaft bearing 356 and the orbiting scroll jacket 320) in an orbiting motion relative to the fixed scroll 304.

Rotation of the crankshaft 340 causes rotation of the bearings 344, 348, and 352, which may result in the generation of a significant amount of heat. To cool the bearings 344, 348, and 352, coolant may be routed into and through the cooling chamber 364 defined by the coupling 376 and coupling jacket 360. Cooling the bearings 344, 348, and 352 in this way may beneficially increase the useful life of the bearings 344, 348, and 352 and reduce the likelihood of premature failure thereof.

Use of a coupling jacket 360 to form a cooling chamber 364 is not limited to the scroll device 300. Any of the scroll devices described herein may be modified to include a coupling jacket 360 and a cooling chamber 364, so as to enable cooling of bearings such as the bearings 344, 352, and 356.

From the aforementioned description, the scroll devices 10, 100, and 200 from the machine class of scroll compressors, vacuum pumps, and expanders have been described. The scroll devices 10, 100, and 200 are capable of expanding and compressing a fluid cyclically to evacuate a line, device, or space connected to the scroll devices 10, 100, and 200 without intrusion of the nearby atmosphere. The scroll devices 10, 100, and 200 receive their motive power directly from a motor or alternatively from a motor connected to a magnetic coupling, further minimizing the incidence of atmospheric intrusion within the housing and the working fluid. The present disclosure and its various components may adapt existing equipment and may be manufactured from many materials including but not limited to metal sheets and foils, elastomers, steel plates, polymers, high density polyethylene, polypropylene, polyvinyl chloride, nylon, ferrous and non-ferrous metals, various alloys, and composites.

In embodiments of the present disclosure, a fixed scroll involute and/or an orbiting scroll involute may comprise a coated or plated involute wall. The coating or plating may be an abrasion-resistant lubricant. The coating or plating may be a self-lubricating coating or plating. The coating or plating may be dry and/or solid. The coating or plating may be or comprise polytetrafluoroethylene. The coating or plating may be resistant to corrosion and useable in environments with temperatures between 35 degrees Celsius and 1000 degrees Celsius, or between 100 degrees Celsius and 750 degrees Celsius, or between 150 degrees Celsius and 500 degrees Celsius, or between 200 degrees Celsius and 300 degrees Celsius. The coating or plating may beneficially reduce or eliminate the existence of gaps in between the fixed scroll involute and the orbiting scroll involute, and may also beneficially reduce friction between the fixed scroll involute and the orbiting scroll involute.

From all that has been said, it will be clear that there has thus been shown and described herein a scroll device having liquid cooling through use of flexible conduits, which may be, for example, flexible tubes, flexible hoses, or flexible bellows. It will become apparent to those skilled in the art, however, that many changes, modifications, variations, and other uses and applications of the subject scroll device are possible and contemplated. All changes, modifications, variations, and other uses and applications which do not depart from the spirit and scope of the disclosure are deemed to be covered by the disclosure, which is limited only by the claims which follow.

Although a barbed fitting has been used for illustration purposes herein, it is possible and contemplated that other types of fittings, such as compression or flared fittings, could be used. The type of fitting is not intended to limit the scope of the present disclosure.

The fixed scroll jackets and orbiting scroll jackets described herein are not limited to the shape or form illustrated in the figures, but may be any coolant retention device suitable for forming a cooling chamber adjacent the fixed and orbiting scroll, respectively, and may comprise more or less of the boundary of a cooling chamber than illustrated or suggested by the figures. Additionally, in some embodiments the fixed scroll and/or the orbiting scroll may entirely define the boundaries of a cooling chamber therein, such that no scroll jacket or coolant retention device is needed.

The term "flexible conduit" is used herein to describe a flexible member to transmit a liquid coolant from one area or volume of a scroll device to another area or volume of the scroll device, and includes without limitation flexible tubes, flexible hoses, flexible metal rods, flexible bellows, and other flexible hollow connectors or devices. The flexible conduit may be made of any suitable material including the materials identified herein.

Although the inlet is described herein as being formed in the housing, the inlet could be in any stationary portion of the scroll device, or more particularly in any portion of the fixed scroll that does not interfere with operation of the scroll device. Other combinations could be equally advantageous, depending on the application, such as the inlet being in a stationary the fixed scroll with a flexible conduit extending between the fixed scroll and orbiting scroll, and with a second flexible conduit extending between the fixed scroll and housing. Other combinations are also contemplated by the present disclosure, such as using a flexible conduit for moving the liquid coolant to or from the orbiting scroll from or to the fixed scroll and/or a motor jacket.

A major heat transfer path in fixed and orbiting scrolls such as those described herein is from the working fluid (e.g., the fluid being compressed by a scroll compressor, or expanded by a scroll expander) into the involute walls, then through the involute walls, through cooling fins (if provided), and into the coolant. In some embodiments of the present disclosure, the involutes of the fixed scroll and/or orbiting scrolls of a scroll device as disclosed herein may be formed of walls that are thicker than currently utilized for such scroll devices. A portion or all of the involute walls may then be hollowed out from the back side of the respective scroll (e.g., from the side of the scroll that partially defines a cooling chamber), whether by machining or otherwise. In alternative embodiments, the involute(s) may be fully or partially hollow as formed. In either case, with the involute walls partially or fully hollowed out, coolant can flow within the involute walls, reducing the distance that heat must travel before reaching the coolant and resulting in more effective cooling. In some embodiments of the present disclosure, the involute walls may be fully or partially hollow and there may be no cooling fins within the corresponding cooling chamber (e.g., the cooling chamber of the orbiting scroll, defined by the orbiting scroll and an orbiting scroll jacket, and/or the cooling chamber of the fixed scroll, defined by the fixed scroll and a fixed scroll jacket). In other embodiments of the present disclosure, the involute walls may be fully or partially hollow, and one or more cooling fins may also be provided in the corresponding cooling chamber. Such cooling fins may or may not be configured to channel fluid from an inlet to the cooling chamber, into the fully or partially hollow involute walls, and to an outlet from the cooling chamber.

Alternatively, the involutes of the fixed and/or orbiting scrolls of a scroll device as disclosed herein may comprise cooling channels formed or otherwise incorporated into the involutes of the fixed and/or orbiting scrolls. In such embodiments, liquid coolant may circulate through the involutes themselves, either instead of or in addition to flowing through a cooling chamber such as the cooling chamber 150. While such an arrangement would require involutes with a greater width than would otherwise be necessary, the coolant would circulate closer to the working fluid, thus permitting improved temperature management. Cooling channels formed or otherwise incorporated into the involute(s) could be machined, cast, or 3D-printed into the involute(s).

Additionally, one or more holes may be drilled into the involute of the fixed scroll and/or into the involute of the orbiting scroll of a scroll device as disclosed herein. Holes in the fixed scroll involute may be in fluid communication with a cooling chamber of the fixed scroll as disclosed herein, and holes in the involute of the orbiting scroll may be in fluid communication with a cooling chamber of the orbiting scroll as disclosed herein. In embodiments provided with such holes, coolant may flow into the channels to provide improved cooling of the involute(s). Moreover, the coolant may be selected (and the coolant circulation system of the scroll device configured) to ensure that the temperature of the coolant approaches but does not exceed the boiling temperature of the coolant, so as to achieve an improved heat transfer coefficient.

In some embodiments in which one or more holes are drilled into the involute of the fixed scroll and/or into the involute of the orbiting scroll, a copper rod may be pressed into one or more of the holes. Because copper has a high thermal conductivity (e.g., about twice as high as the thermal conductivity of aluminum), the use of copper rods as described improves heat transfer (if the thermal conductivity of the copper is higher than the thermal conductivity of the metal from which the involute is formed, which may be, for example, aluminum) from the involute to the coolant. The copper rod(s) may extend from the hole and into the cooling chamber or passageway or other coolant flow path to further improve heat transfer to the coolant.

Also in some embodiments, a heat exchanger plate (which may, for example, comprise copper tubes cast therein or otherwise affixed thereto, copper fins, and/or any other materials and structures adapted for improved heat transfer) may be mounted to one or both of the fixed and orbiting scrolls of a scroll device as described herein. Such a heat exchanger plate may be mounted inside a cooling chamber as described herein, and/or may perform the functions of a jacket or coolant retention device as described herein, and/or may be provided with one or more coolant passageways so as to allow the circulation of coolant therethrough.

Also in some embodiments of the present disclosure, 3D metal printing may be used to manufacture the fixed scroll (including the involute thereof), orbiting scroll (including the involute thereof), and/or other components of a scroll device. While 3D-printed scrolls would likely still need final machining to achieve required tolerances, this would beneficially enable liquid coolant channels to be formed inside the component in question during 3D printing thereof, without regard for the limitations that accompany normal machining/drilling operations. Indeed, complex cooling channels and/or cooling channel networks may be incorporated into a 3D-printed scroll, including through the involute thereof and the back side thereof. By utilizing such channels, formed directly within the fixed scroll and/or the orbiting scroll, to cool the scroll, the need for a scroll jacket and a cooling chamber may be eliminated.

The present disclosure will work equally as well for other types of scroll devices where idler shafts are not used, such as scroll compressors with Oldham rings or a bellows for alignment of the scrolls.

In an alternative liquid cooling configuration, a scroll device as described herein may be cooled by spraying liquid coolant on the fixed scroll, the orbiting scroll, and/or a housing of the scroll device. The sprayed liquid coolant may be drawn from a reservoir positioned underneath the fixed scroll, the orbiting scroll, and/or the housing, into which reservoir the sprayed coolant may fall as it runs down and drips off of the fixed scroll, the orbiting scroll, and/or the housing of the scroll device. Liquid cooling in this manner may be utilized, for example, for scroll devices that are completely sealed. Depending on the level of cooling required or desired, liquid coolant spraying as described herein may be used as an alternative to the use of cooling chambers and/or flexible conduits as described elsewhere herein, or may be used in addition to the use of cooling chambers and/or flexible conduits.

In still another alternative liquid cooling configuration, a scroll device as described herein may comprise a first cooling loop for circulating coolant through a cooling chamber and/or one or more coolant passageways associated with a fixed scroll thereof, and a second, independent cooling loop for circulating coolant through a cooling chamber and/or one or more coolant passageways associated with an orbiting scroll thereof. In embodiments comprising a cooling chamber or passageway associated with a motor operably connected to the scroll device (whether the cooling chamber or passageway is formed by a motor jacket or not), the cooling chamber or passageway associated with the motor may be part of the first cooling loop, the second cooling loop, or a third, independent cooling loop. Where separate cooling loops are used for cooling the first scroll, the orbiting scroll, and/or the motor, a leak or other fault in one cooling loop beneficially will not compromise the other cooling loop(s), which may continue to operate and may allow the scroll device to continue to be operated even if the faulty cooling loop were to be shut off.

In embodiments comprising separate cooling loops as described above, coolant may be provided to each cooling loop from one or more stationary positions that are part of or separate from the scroll device.

Therefore, the present disclosure provides a new and improved scroll device from the machine class of compressors, vacuum pumps, and expanders for gases that incorporates liquid cooling through the use of one or more flexible conduits.

The present disclosure provides a scroll type device that is capable of operating at lower temperatures than existing scroll devices designed to operate at comparable pressures.

The present disclosure also provides a scroll device that is capable of longer life as compared to other scroll type devices. The present disclosure provides a scroll device that is capable of reducing heat generated by the scroll device through the use of a cooling fluid or liquid that may flow through through one or more flexible conduits.

The present disclosure further provides a scroll device that has channels or cooling fins for a cooling fluid or liquid to flow therein to reduce the temperature of components of the scroll device, such as involutes and bearings, so that the useful life thereof is increased.

The present disclosure also provides a scroll device that employs a fin design to force the flow of any cooling fluid or liquid within the scroll device to reduce any stagnated flow of the cooling fluid or liquid.

The present disclosure is also directed to a scroll device that employs flexible conduits such as flexible tubes or bellows to allow a cooling fluid or liquid to flow therein to cool the scroll device.

A number of variations and modifications of the disclosure can be used. It would be possible to provide for some features of the disclosure without providing others.

A scroll device according to one embodiment of the present disclosure comprises: a fixed scroll comprising a first involute and a first cooling chamber; an orbiting scroll comprising a second involute and a second cooling chamber, the orbiting scroll mounted to the fixed scroll via a mechanical coupling, the orbiting scroll configured to orbit relative to the fixed scroll around an orbital axis; and a flexible conduit in fluid communication with the first cooling chamber and the second cooling chamber, the flexible conduit extending around the orbital axis from a first side of the scroll device to a second side of the scroll device.

Aspects of the foregoing scroll device include: wherein the first cooling chamber is at least partially defined by a fixed scroll jacket, and the second cooling chamber is at least partially defined by an orbiting scroll jacket; a second flexible conduit extending from the first side to the opposite side of the scroll device, the second flexible conduit in fluid communication with a coolant inlet and the second cooling chamber; wherein the first cooling chamber comprises a first inlet and a first outlet, and the second cooling chamber comprises a second inlet and a second outlet, and further wherein the second flexible conduit channels coolant from the coolant inlet to the second inlet, and the first flexible conduit channels coolant from the second outlet to the first inlet; wherein the coolant inlet is on the first side, the first inlet is on the opposite side, and the first outlet is positioned on a fixed scroll jacket; wherein the coolant inlet is positioned on a stationary portion of the scroll device; at least one cooling fin extending into the first cooling chamber; wherein the at least one cooling fin is arranged to channel coolant from the first inlet to the first outlet; wherein the first involute comprises a base, a coated or plated wall, and a tip seal groove; and wherein the coated or plated wall is coated or plated with a solid abrasion resistant lubricant.

A scroll device according to another embodiment of the present disclosure comprises: an orbiting scroll mounted to a fixed scroll via at least one mechanical coupling, the orbiting scroll configured to orbit relative to the fixed scroll around an orbital axis, the fixed scroll comprising: a first involute extending toward the orbiting scroll; a first cooling chamber; and a first plurality of cooling fins extending away from the orbiting scroll into the first cooling chamber; a flexible conduit in fluid communication with the first cooling chamber, the flexible conduit having a first end connected to the fixed scroll, a second end connected to the orbiting scroll, and a length that bends around the orbital axis.

Aspects of the foregoing scroll device include: wherein the flexible conduit extends substantially perpendicularly to the orbital axis; wherein the fixed scroll further comprises a fixed scroll jacket, the fixed scroll jacket defining a wall of the first cooling chamber; wherein the orbiting scroll comprises: a second cooling chamber and a second plurality of cooling fins extending away from the orbiting scroll into the second cooling chamber; wherein the orbiting scroll further comprises: an orbiting scroll jacket, the orbiting scroll jacket defining a wall of the second cooling chamber and comprising a crankshaft bearing.

A liquid-cooled scroll device according to another embodiment of the present disclosure comprises: a fixed scroll comprising a first coolant passageway; an orbiting scroll comprising a second coolant passageway; a motor operably connected to the orbiting scroll, the motor causing the orbiting scroll to orbit relative to the fixed scroll around an orbital axis; and a flexible conduit that curves around the orbital axis, the flexible conduit in fluid communication with the first coolant passageway and the second coolant passageway.

Aspects of the foregoing liquid-cooled scroll device include: a motor jacket at least partially surrounding the motor, the motor jacket comprising a third coolant passageway; wherein the third coolant passageway comprises an inlet, an outlet, and a plurality of cooling fins; a second flexible conduit in fluid communication with the second coolant passageway and the third coolant passageway; and wherein the fixed scroll or the orbiting scroll comprises an involute having a wall coated or plated with a solid abrasion-resistant lubricant.

Ranges have been discussed and used within the forgoing description. One skilled in the art would understand that any sub-range within the stated range would be suitable, as would any number or value within the broad range, without deviating from the invention. Additionally, where the meaning of the term "about" as used herein would not otherwise be apparent to one of ordinary skill in the art, the term "about" should be interpreted as meaning within plus or minus five percent of the stated value.

Throughout the present disclosure, various embodiments have been disclosed. Components described in connection with one embodiment are the same as or similar to like-numbered components described in connection with another embodiment.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present disclosure.

The present disclosure, in various aspects, embodiments, and/or configurations, includes components, methods, processes, systems and/or apparatus substantially as depicted and described herein, including various aspects, embodiments, configurations embodiments, subcombinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

The foregoing discussion has been presented for purposes of illustration and description. The foregoing is not intended to limit the disclosure to the form or forms disclosed herein. In the foregoing Detailed Description, for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

Any of the steps, functions, and operations discussed herein can be performed continuously and automatically.

What is claimed is:

1. A scroll device comprising:

a fixed scroll comprising a first involute and a first cooling chamber;

an orbiting scroll comprising a second involute and a second cooling chamber, the orbiting scroll mounted to the fixed scroll via a mechanical coupling, the orbiting scroll configured to orbit relative to the fixed scroll around an orbital axis;

a first flexible conduit in fluid communication with the first cooling chamber and the second cooling chamber, the first flexible conduit extending radially around the orbital axis from a first side of the scroll device to a second side of the scroll device; and a second flexible conduit extending from the first side to the second side of the scroll device, the second flexible conduit in fluid communication with a coolant inlet and the second cooling chamber, wherein the first cooling chamber comprises a first inlet and a first outlet, and the second cooling chamber comprises a second inlet and a second outlet, and further wherein the second flexible conduit channels coolant from the coolant inlet to the second inlet, and the first flexible conduit channels coolant from the second outlet to the first inlet.

2. The scroll device of claim 1, wherein the first cooling chamber is at least partially defined by a fixed scroll jacket, and the second cooling chamber is at least partially defined by an orbiting scroll jacket.

3. The scroll device of claim 1, wherein the coolant inlet is on the first side, the first inlet is on the opposite side, and the first outlet is positioned on a fixed scroll jacket.

4. The scroll device of claim 3, wherein the coolant inlet is positioned on a stationary portion of the scroll device.

5. The scroll device of claim 1, further comprising at least one cooling fin extending into the first cooling chamber.

6. The scroll device of claim 5, wherein the at least one cooling fin is arranged to channel coolant from a first inlet to a first outlet,.

7. The scroll device of claim 1, wherein the first involute comprises a base, a coated or plated wall, and a tip seal groove, and wherein the coated or plated wall is coated or plated with a solid abrasion resistant lubricant.

8. The scroll device of claim 1, wherein at least one of the fixed scroll and the orbiting scroll comprises a polytetrafluoroethylene (PTFE) coating.

9. A scroll device comprising:

an orbiting scroll mounted to a fixed scroll via at least one mechanical coupling, the orbiting scroll configured to orbit relative to the fixed scroll around an orbital axis, the fixed scroll comprising:

a first involute extending toward the orbiting scroll;

a first cooling chamber;

a second cooling chamber;

a first plurality of cooling fins extending away from the fixed scroll into the first cooling chamber;

a first flexible conduit in fluid communication with the first cooling chamber, the first flexible conduit having a first end connected to the fixed scroll, a second end connected to the orbiting scroll, and a length that radially bends around the orbital axis; and a second flexible conduit in fluid communication with a coolant inlet and the second cooling chamber, the second flexible conduit having a length that radially bends around the orbital axis, wherein the first cooling chamber comprises a first inlet and a first outlet, and the second cooling chamber comprises a second inlet and a second outlet, and further wherein the second flexible conduit channels coolant from the coolant inlet to the second inlet, and the first flexible conduit channels coolant from the second outlet to the first inlet.

10. The scroll device of claim 9, wherein the first flexible conduit extends substantially perpendicularly to the orbital axis.

11. The scroll device of claim 9, wherein the fixed scroll further comprises a fixed scroll jacket, the fixed scroll jacket defining a wall of the first cooling chamber.

12. The scroll device of claim 9, wherein the orbiting scroll comprises:

a second plurality of cooling fins extending away from the orbiting scroll into the second cooling chamber.

13. The scroll device of claim 12, wherein the orbiting scroll further comprises:

an orbiting scroll jacket, the orbiting scroll jacket defining a wall of the second cooling chamber and comprising a crankshaft bearing.

14. A liquid-cooled scroll device comprising:

a fixed scroll comprising a first coolant passageway;

an orbiting scroll comprising a second coolant passageway;

a motor operably connected to the orbiting scroll, the motor causing the orbiting scroll to orbit relative to the fixed scroll around an orbital axis;

a first flexible conduit that radially curves around the orbital axis, the first flexible conduit in fluid communication with the first coolant passageway and the second coolant passageway; and a second flexible conduit in fluid communication with a coolant inlet and the second coolant passageway, the second flexible conduit that radially curves around the orbital axis, wherein the first coolant passageway comprises a first inlet and a first outlet, and the second coolant passageway comprises a second inlet and a second outlet, and further wherein the second flexible conduit channels coolant from the coolant inlet to the second inlet, and the first flexible conduit channels coolant from the second outlet to the first inlet.

15. The liquid-cooled scroll device of claim 14, further comprising:

a motor jacket at least partially surrounding the motor, the motor jacket comprising a third coolant passageway.

16. The liquid-cooled scroll device of claim 15, wherein the third coolant passageway comprises an inlet, an outlet, and a plurality of cooling fins.

17. The liquid-cooled scroll device of claim 16, wherein the second flexible conduit is in fluid communication with the second coolant passageway and the third coolant passageway.

18. The liquid-cooled scroll device of claim 14, wherein the fixed scroll or the orbiting scroll comprises an involute having a wall coated or plated with a solid abrasion-resistant lubricant.

* * * * *